US009427075B2

(12) United States Patent
Gueret

(10) Patent No.: US 9,427,075 B2
(45) Date of Patent: Aug. 30, 2016

(54) APPLICATOR FOR COMBING THE EYELASHES OR THE EYEBROWS OR FOR APPLYING A COMPOSITION THERETO

(75) Inventor: Jean-Louis Gueret, Paris (FR)

(73) Assignee: L'OREAL S.A., Paris (FR)

( * ) Notice: Subject to any disclaimer, the term of this patent is extended or adjusted under 35 U.S.C. 154(b) by 0 days.

(21) Appl. No.: 12/739,398

(22) PCT Filed: Oct. 23, 2008

(86) PCT No.: PCT/IB2008/054380
§ 371 (c)(1),
(2), (4) Date: Aug. 11, 2010

(87) PCT Pub. No.: WO2009/053926
PCT Pub. Date: Apr. 30, 2009

(65) Prior Publication Data

US 2010/0310296 A1 Dec. 9, 2010

Related U.S. Application Data

(60) Provisional application No. 60/985,108, filed on Nov. 2, 2007, provisional application No. 61/102,632, filed on Oct. 3, 2008.

(30) Foreign Application Priority Data

Oct. 23, 2007 (FR) ..... 07 58529

(51) Int. Cl.
*A46B 9/02* (2006.01)
*A45D 40/26* (2006.01)
*A46B 3/00* (2006.01)

(52) U.S. Cl.
CPC ..... *A46B 9/021* (2013.01); *A45D 40/267* (2013.01); *A46B 3/005* (2013.01); *A46B 9/028* (2013.01); *A46B 2200/106* (2013.01); *A46B 2200/1053* (2013.01)

(58) Field of Classification Search
CPC .. A45D 34/04; A45D 34/042; A45D 40/265; A45D 40/267; A46B 2200/1053; A46B 2200/106; A46B 3/005; A46B 9/021; A46B 9/028
USPC ..... 401/126, 129; 15/187–188, DIG. 5, 15/DIG. 6; 132/126, 137, 139–142, 218, 132/313, 320; 1/126, 129
See application file for complete search history.

(56) References Cited

U.S. PATENT DOCUMENTS 3,998,232 A 12/1976 Smith
4,403,624 A 9/1983 Montgomery
(Continued)

FOREIGN PATENT DOCUMENTS

DE 25 59 273 A1 7/1977
DE 199 11 763 A1 9/2000
(Continued)

OTHER PUBLICATIONS

U.S. Office Action dated Apr. 10, 2013 from U.S. Appl. No. 12/739,356.
(Continued)

*Primary Examiner* — Rachel Steitz
*Assistant Examiner* — Jennifer Gill
(74) *Attorney, Agent, or Firm* — Oliff PLC

(57) ABSTRACT

The present invention relates to an applicator for combing the eyelashes and/or the eyebrows, and/or for applying a cosmetic, makeup, or a care product thereto, the applicator comprising a molded applicator member (8) that comprises: an inner core that is elongate along a longitudinal axis, and comprising opposite first and second portions that each extend along the longitudinal axis; and a plurality of rows of teeth, the rows extending along the longitudinal axis of the applicator member, with first rows and second rows of teeth extending from the first and second portions of the core respectively; at least half of the teeth of at least two consecutive first rows differing from at least half of the teeth of at least two consecutive second rows in thickness.

56 Claims, 10 Drawing Sheets

(56) References Cited

U.S. PATENT DOCUMENTS

| | | | | |
|---|---|---|---|---|
| 4,561,456 | A | 12/1985 | Gueret | |
| 4,565,205 | A | 1/1986 | Taylor | |
| 4,635,659 | A | 1/1987 | Spatz | |
| 4,660,582 | A | 4/1987 | Taylor | |
| 4,810,122 | A | 3/1989 | Cole | |
| 4,898,193 | A | 2/1990 | Gueret | |
| 4,964,429 | A | 10/1990 | Cole | |
| 6,260,558 | B1 | 7/2001 | Neuner | |
| 6,328,495 | B1 | 12/2001 | Gueret | |
| 6,343,607 | B1 | 2/2002 | Gueret | |
| 6,375,374 | B2 | 4/2002 | Gueret | |
| 6,408,857 | B1 * | 6/2002 | Neuner | 132/218 |
| 6,412,496 | B1 * | 7/2002 | Gueret | 132/218 |
| 6,494,215 | B2 * | 12/2002 | Gueret | 132/218 |
| 6,539,950 | B1 | 4/2003 | Gueret | |
| 6,581,610 | B1 | 6/2003 | Gueret | |
| RE38,230 | E | 8/2003 | Gueret | |
| 6,616,366 | B1 | 9/2003 | Weihrauch | |
| 6,669,389 | B2 | 12/2003 | Gueret | |
| 6,681,777 | B2 | 1/2004 | Gueret | |
| 7,171,969 | B2 | 2/2007 | Gueret | |
| 7,231,926 | B2 | 6/2007 | Kim | |
| 7,254,860 | B2 | 8/2007 | Dumler et al. | |
| 7,261,483 | B2 | 8/2007 | Gueret | |
| 7,325,550 | B2 | 2/2008 | Eckers et al. | |
| D573,348 | S | 7/2008 | Dumler et al. | |
| 7,581,546 | B2 | 9/2009 | Dumler | |
| 7,581,898 | B2 | 9/2009 | Gueret | |
| 7,665,473 | B1 | 2/2010 | Gueret | |
| 7,686,528 | B2 | 3/2010 | Gueret | |
| 7,921,857 | B2 | 4/2011 | Gueret | |
| 7,946,778 | B2 | 5/2011 | Gueret | |
| 8,056,569 | B2 | 11/2011 | Berhault | |
| 8,096,306 | B2 | 1/2012 | Malvar et al. | |
| 8,100,138 | B2 | 1/2012 | Gueret | |
| 8,122,895 | B2 | 2/2012 | Gueret | |
| 8,127,777 | B2 | 3/2012 | Gueret | |
| 2001/0037815 | A1 | 11/2001 | Gueret | |
| 2002/0023657 | A1 | 2/2002 | Gueret | |
| 2003/0213498 | A1 | 11/2003 | Gueret | |
| 2004/0221865 | A1 * | 11/2004 | Kim | 132/218 |
| 2004/0244808 | A1 | 12/2004 | Mathiez | |
| 2004/0258453 | A1 | 12/2004 | Gueret | |
| 2005/0028834 | A1 | 2/2005 | Ramet | |
| 2005/0034740 | A1 | 2/2005 | Eckers et al. | |
| 2005/0081874 | A1 | 4/2005 | Mathiez | |
| 2005/0175394 | A1 | 8/2005 | Gueret | |
| 2005/0258569 | A1 | 11/2005 | Schoemann et al. | |
| 2006/0056903 | A1 | 3/2006 | Gueret | |
| 2006/0070635 | A1 | 4/2006 | Dumier et al. | |
| 2006/0093425 | A1 | 5/2006 | Gueret | |
| 2006/0272666 | A1 | 12/2006 | Wyatt et al. | |
| 2007/0033759 | A1 | 2/2007 | Dumler | |
| 2007/0033760 | A1 | 2/2007 | Dumler | |
| 2007/0079845 | A1 * | 4/2007 | Gueret | 132/218 |
| 2008/0011317 | A1 * | 1/2008 | Malvar et al. | 132/218 |
| 2008/0023020 | A1 | 1/2008 | Gueret | |
| 2008/0115798 | A1 | 5/2008 | Rainey et al. | |
| 2008/0245382 | A1 | 10/2008 | Marciniak-Davoult et al. | |
| 2008/0251093 | A1 * | 10/2008 | Gueret | 132/200 |
| 2008/0283077 | A1 | 11/2008 | Gueret | |
| 2009/0065018 | A1 * | 3/2009 | Berhault | 132/218 |
| 2009/0114239 | A1 * | 5/2009 | Chen | 132/218 |
| 2009/0193602 | A1 | 8/2009 | Dumler et al. | |
| 2010/0175708 | A1 | 7/2010 | Kim | |

FOREIGN PATENT DOCUMENTS

| | | | |
|---|---|---|---|
| DE | 101 02 219 | A1 | 7/2002 |
| DE | 20 2007 008 147 | U1 | 11/2007 |
| EP | 0 075 051 | | 3/1983 |
| EP | 1 161 896 | A1 | 12/2001 |
| EP | 1 188 393 | B1 | 3/2002 |
| EP | 1 236 419 | B1 | 9/2002 |
| EP | 1 342 428 | A1 | 9/2003 |
| EP | 1 344 470 | B1 | 9/2003 |
| EP | 1 358 818 | B1 | 11/2003 |
| EP | 1 584 260 | B1 | 10/2005 |
| EP | 1 602 300 | B1 | 12/2005 |
| EP | 1 611 817 | A1 | 1/2006 |
| EP | 1 632 149 | B1 | 3/2006 |
| EP | 1 649 777 | A2 | 4/2006 |
| EP | 1 665 952 | A2 | 6/2006 |
| EP | 1 752 066 | B1 | 2/2007 |
| EP | 1 752 067 | B1 | 2/2007 |
| EP | 1 872 682 | A1 | 1/2008 |
| EP | 1 977 662 | A1 | 10/2008 |
| FR | 2 505 633 | | 11/1982 |
| FR | 2 564 712 | A1 | 11/1985 |
| FR | 2 605 505 | A1 | 4/1988 |
| FR | 2 891 709 | A1 | 4/2007 |
| FR | 2 897 762 | A1 | 8/2007 |
| GB | 2 071 558 | A | 9/1981 |
| GB | 2 159 699 | A | 12/1985 |
| JP | A-2007-117602 | | 5/2007 |
| WO | WO 95/17837 | | 7/1995 |
| WO | WO 01/05273 | A1 | 1/2001 |
| WO | WO 01/05274 | A1 | 1/2001 |
| WO | WO 02/056726 | A2 | 7/2002 |
| WO | WO 2006/090343 | A1 | 8/2006 |
| WO | WO 2006/124228 | A1 | 11/2006 |
| WO | WO 2006/125122 | A1 | 11/2006 |
| WO | WO 2007114551 | * | 10/2007 |

OTHER PUBLICATIONS

International Search Report for PCT/IB2008/054380, dated Apr. 21, 2009.

English language abstract of FR 2 891 709 A1, Apr. 13, 2007.

English language abstract of FR 2 897 762 A1, Aug. 31, 2007.

Third Party Submission dated Mar. 31, 2014 submitted in European Patent Application No. 08842187.0 (corresponding to U.S. Appl. No. 12/739,363).

"Guide to Overmolding With Melt Processible Elastomers (MPEs);" *Advanced Polymer Alloys*; Nov. 29, 2006; pp. 1-10.

Third Party Submission dated Apr. 2, 2014 submitted in European Patent Application No. 08841710.0 (corresponding to U.S. Appl. No. 12/739,356).

Third Party Submission dated May 2, 2014 submitted in European Patent Application No. 08841950.2 (corresponding to U.S. Appl. No. 12/739,398).

Third Party Submission dated May 2, 2014 submitted in European Patent Application No. 08841542.7 (corresponding to U.S. Appl. No. 12/739,338).

U.S. Office Action dated Apr. 11, 2014 from U.S. Appl. No. 12/739,356.

U.S. Office Action dated Mar. 28, 2014 from U.S. Appl. No. 12/739,363.

U.S. Office Action dated Jan. 7, 2013 from U.S. Appl. No. 12/739,338.

http:www.calce.umd.edu/TSFA/Hardness_ad_.htm.

Office Action issued Aug. 10, 2011 in Chinese Patent Application No. 200880112706.X.

Office Action issued Feb. 2, 2012 in U.S. Appl. No. 12/739,363.

Office Action issued Jul. 11, 2012 in U.S. Appl. No. 12/739,363.

"Hytrel® . . . a thermoplastic and elastomer in one;" Dupont™ Hytrel® TPC-ET thermoplastic polyester elastomer; http://www2.dupont.com/Plastics/en_US/Products/Hytrel/Hytrel.html.

"Hardness Scale—Durometer Comparisons of Materials;" Plastics International; http://www.plasticsintl.com/polyhardness.htm.

Campo, Alfred; "Selection of Polymeric Materials;" Norwich; 2008; pp. 19; William Andrew Inc.

U.S. Office Action dated Mar. 1, 2013 from U.S. Appl. No. 12/739,636.

U.S. Office Action dated Oct. 10, 2013 from U.S. Appl. No. 12/739,363.

Sep. 27, 2012 Office Action issued in U.S. Appl. No. 12/739,356.

Copending U.S. Appl. No. 12/739,338, filed Apr. 22, 2010.

Copending U.S. Appl. No. 12/739,356, filed Apr. 22, 2010.

Copending U.S. Appl. No. 12/739,363, filed Apr. 22, 2010.

(56) References Cited

OTHER PUBLICATIONS

English language Abstract of DE 25 59 273 A1, dated Jul. 7, 1977.
English language abstract of EP 1 602 300 B1, dated Dec. 7, 2005.
English language Abstract of EP 1 665 952 A2, dated Jun. 7, 2006.
English language abstract of EP 1 752 067 B1, dated Feb. 14, 2007.
International Search Report for PCT/IB2008/054375, dated Apr. 8, 2009.
International Search Report for PCT/IB2008/054379, dated Apr. 7, 2009.
International Search Report for PCT/IB2008/054383, dated Feb. 11, 2009.

* cited by examiner

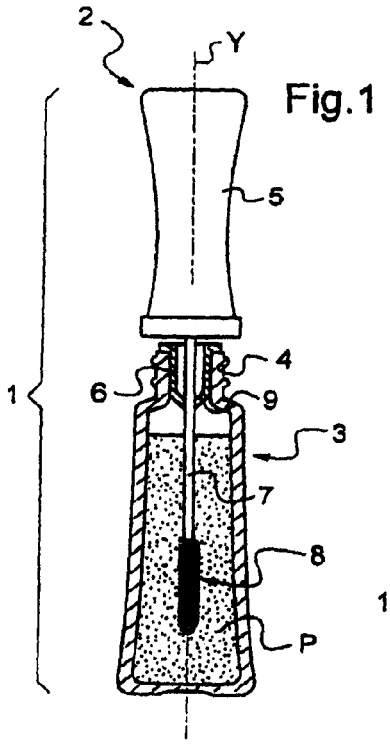
Fig.1
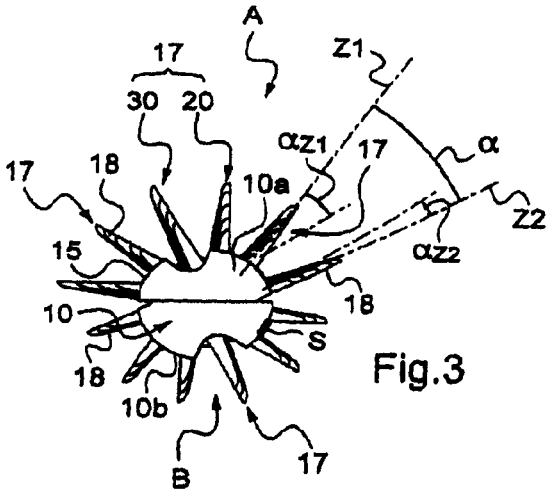
Fig.3
Fig.2
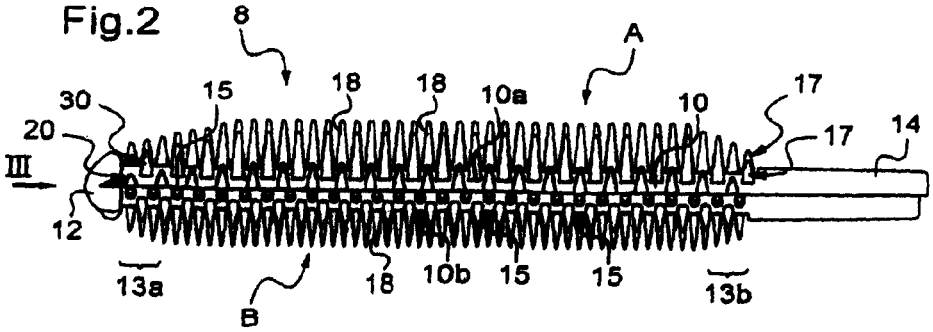

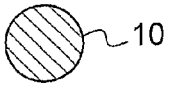
Fig.10
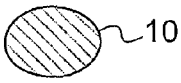
Fig.11
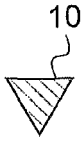
Fig.12
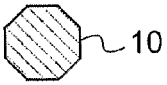
Fig.13
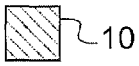
Fig.14
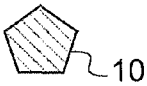
Fig.15
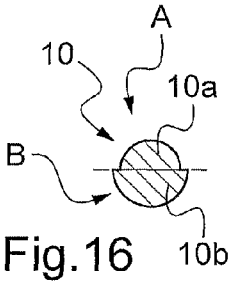
Fig.16
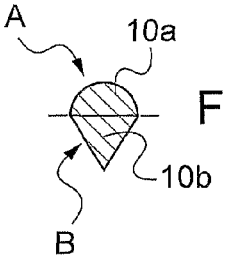
Fig.17
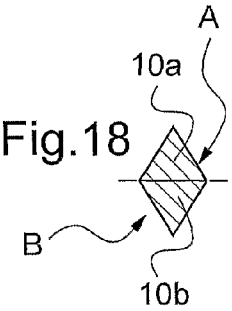
Fig.18
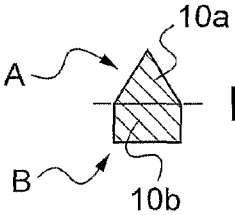
Fig.19
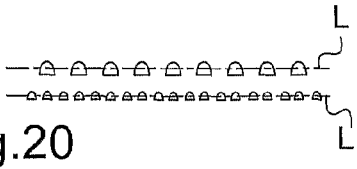
Fig.20
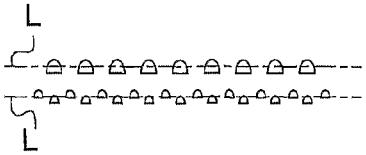
Fig.21
Fig.22
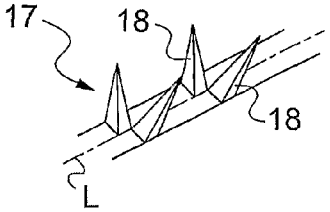
Fig.22a
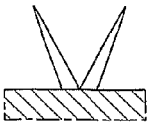

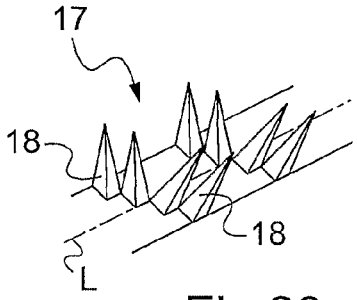
Fig.23
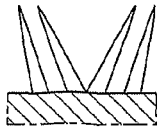
Fig.23a
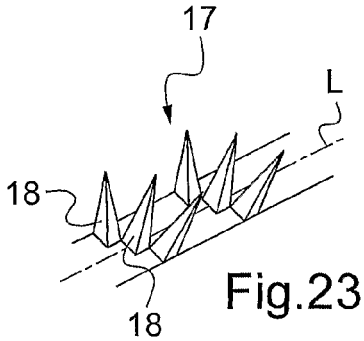
Fig.23b
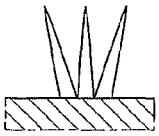
Fig.23c
Fig.24
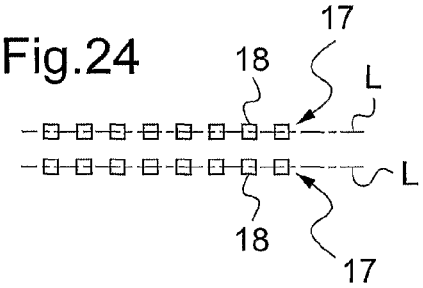
Fig.25
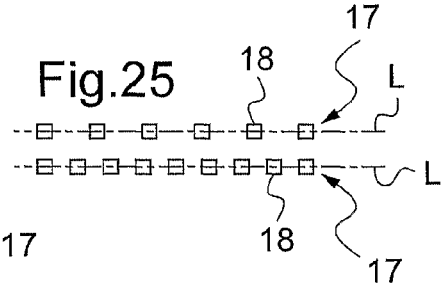
Fig.26
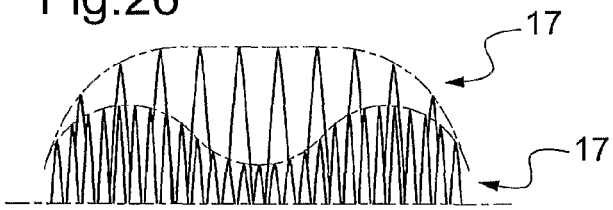
Fig.26a
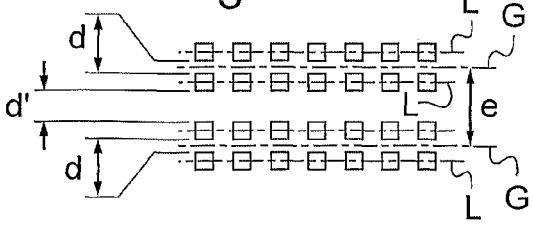
Fig.26b
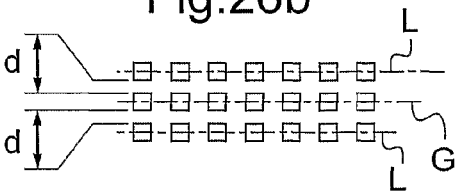
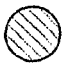
Fig.27
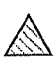
Fig.28
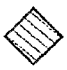
Fig.29
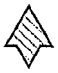
Fig.30
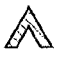
Fig.31

Fig.32
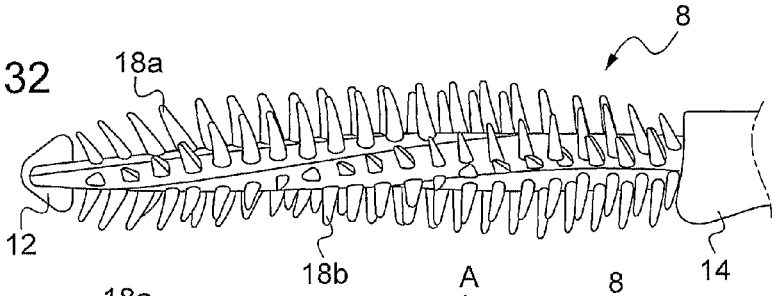
Fig.33
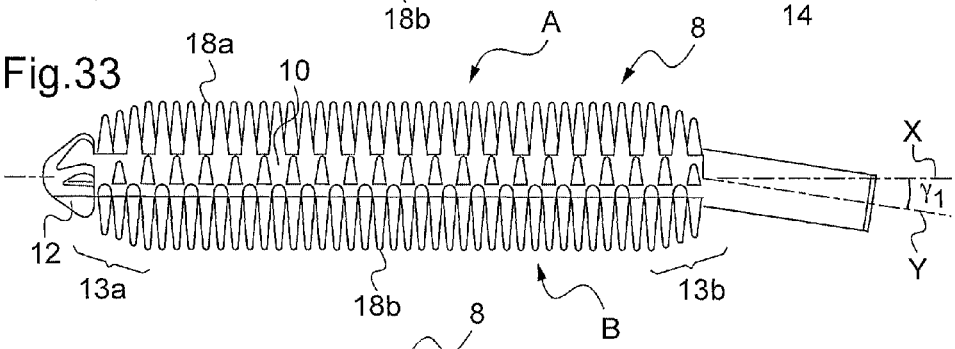
Fig.34
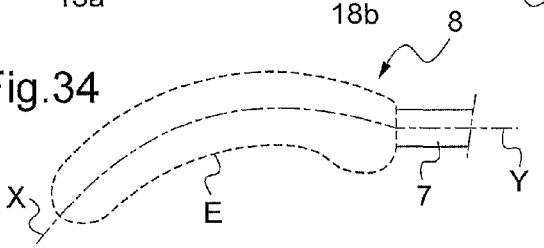
Fig.35
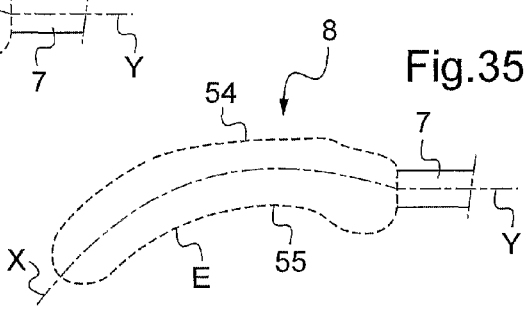
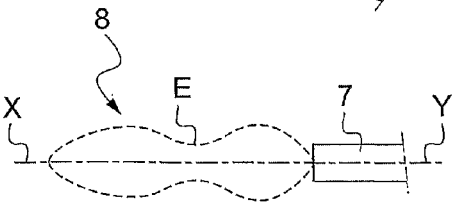
Fig.36
Fig.37
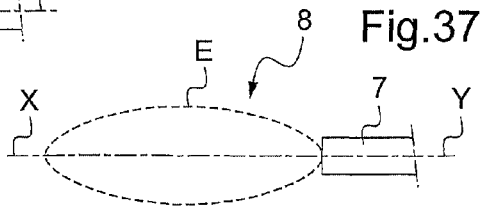
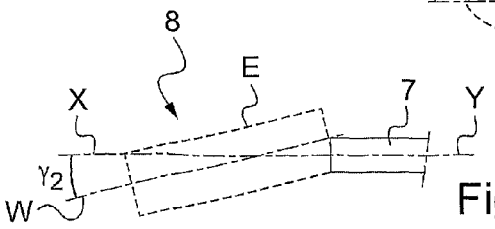
Fig.38

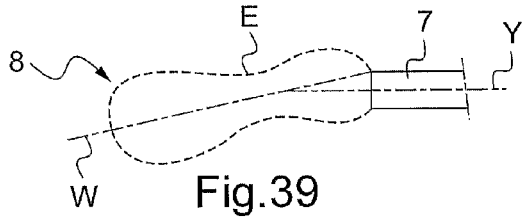
Fig.39
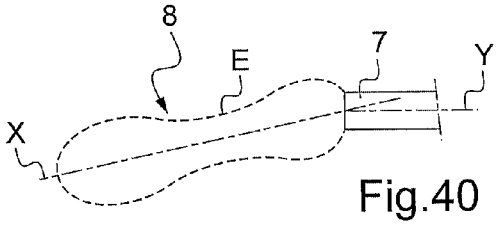
Fig.40
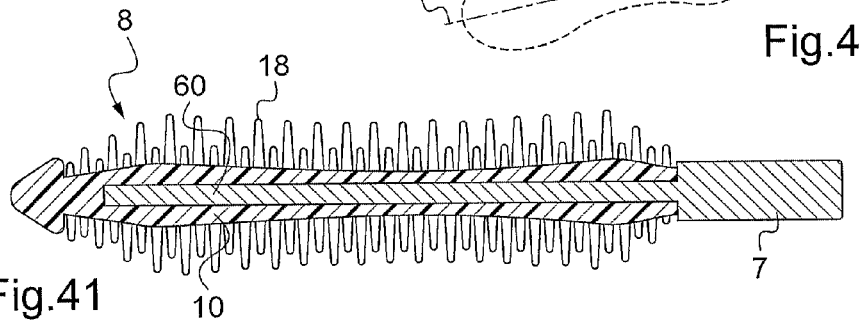
Fig.41
Fig.42
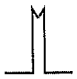
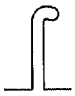
Fig.43
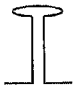
Fig.44
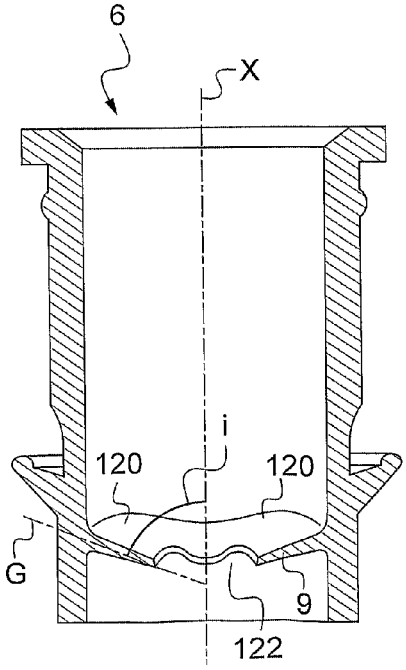
Fig.45
Fig.46
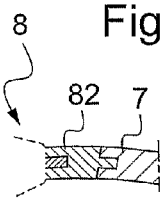
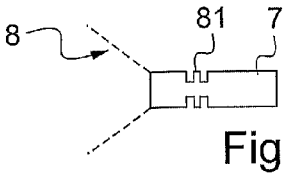
Fig.47

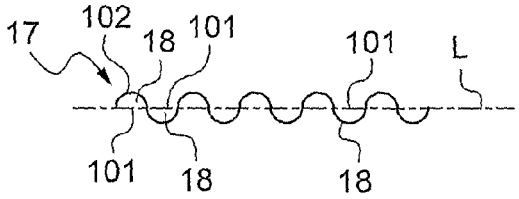
Fig.49
Fig.50
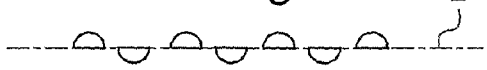
Fig.51
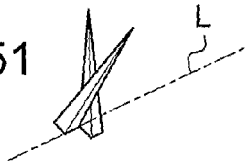
Fig.53
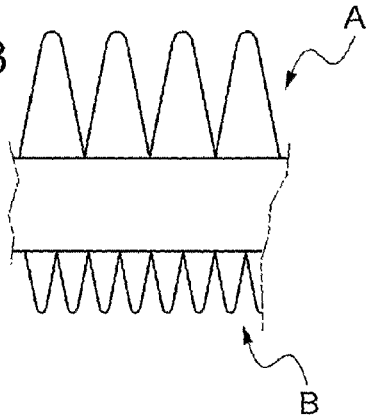
Fig.52
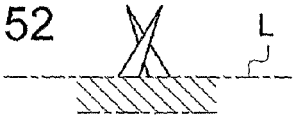
Fig.54
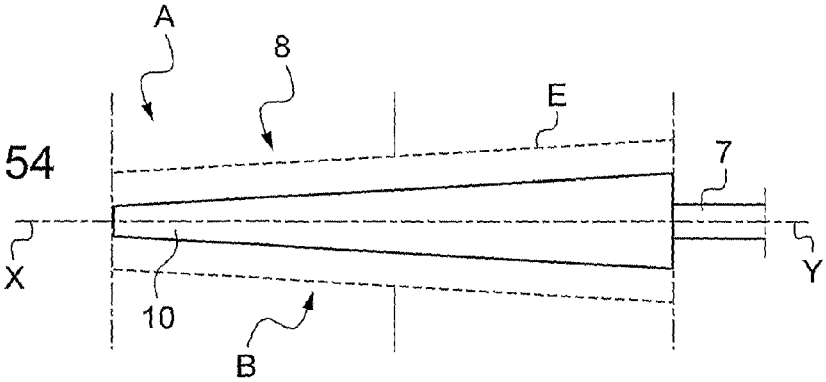
Fig.55
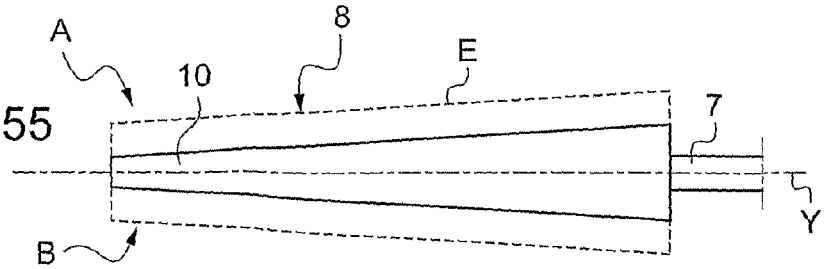

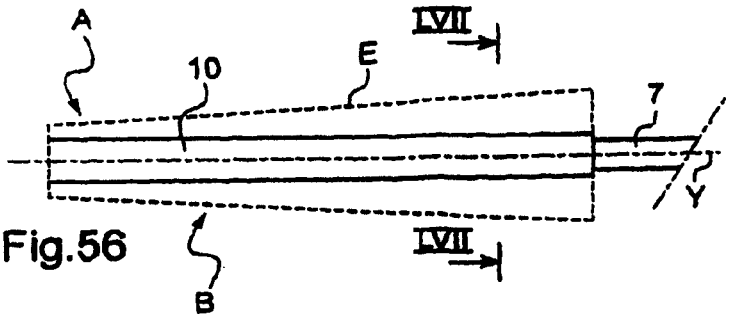
Fig.56
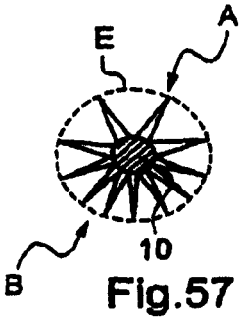
Fig.57
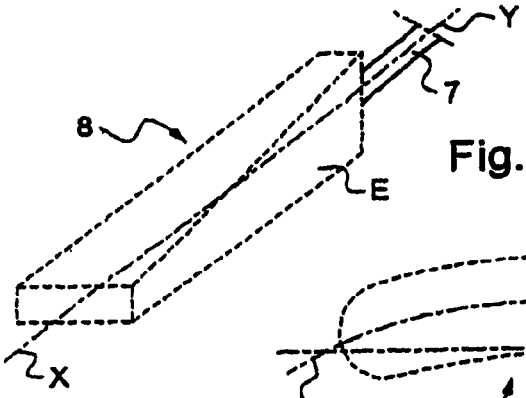
Fig.58
Fig.59
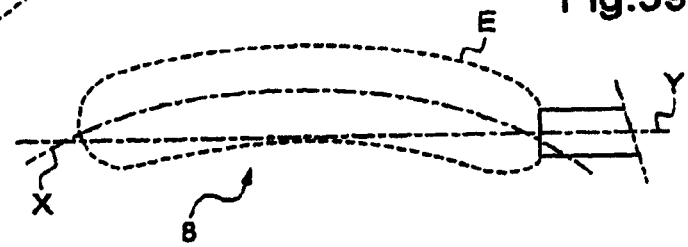
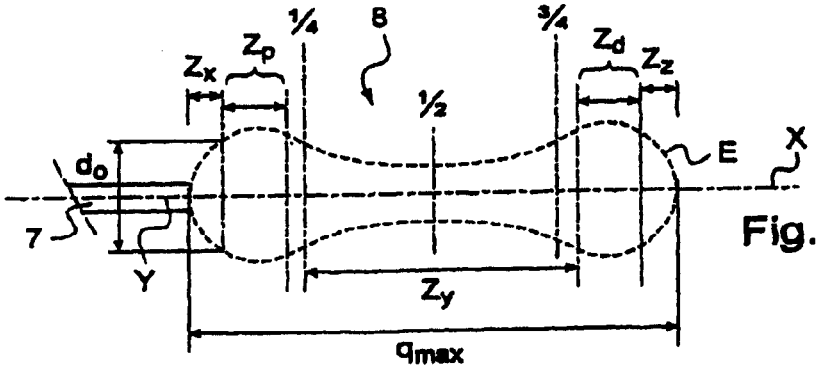
Fig.60
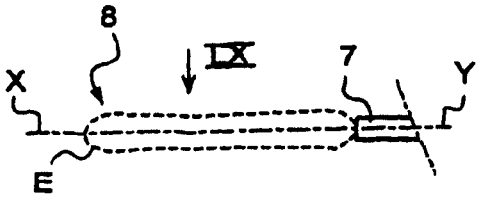
Fig.61

APPLICATOR FOR COMBING THE EYELASHES OR THE EYEBROWS OR FOR APPLYING A COMPOSITION THERETO

This application is a national phase of International Patent Application No. PCT/IB2008/054380, filed Oct. 23, 2008, and claims the right to priority under 35 U.S.C. §119 based on French Patent Application No. 07 58529, filed Oct. 23, 2007, claims the right to priority under 35 U.S.C. §119(e) based on U.S. Provisional Application No. 60/985,108, filed Nov. 2, 2007, and claims the right to priority under 35 U.S.C. §119(e) based on U.S. Provisional Application No. 61/102,632, filed Oct. 3, 2008, the contents of all of which are incorporated herein by reference in their entirety.

The present invention relates to an applicator for combing keratinous fibers, in particular the eyelashes and/or the eyebrows, and/or for applying a cosmetic, makeup, or a care product, e.g. mascara, thereto.

The invention also relates to a packaging device comprising such an applicator.

The invention also relates to a cosmetic treatment.

Application GB 2 071 558 and application EP 1 611 817 disclose a mascara applicator comprising teeth that extend from a central core in directions that are different, the teeth being disposed regularly over the support, with spacing that is constant.

U.S. Pat. No. 4,565,205 discloses a mascara comb comprising teeth of lengths that are different, and extending from a central support in directions that are parallel to one another.

Application US 2006/279181 discloses a mascara applicator having a core provided with teeth on two opposite faces. The applicator member has an axis of symmetry and the application characteristics are the same for both faces.

Application EP 1 632 149 describes an applicator having at least two rows of teeth that differ in the spacing of the teeth in the rows.

Application US 2006/0272666 A1 discloses an applicator member comprising a core carrying long teeth on one side and shorter teeth on the other. That application also describes an applicator member having teeth at a greater angular density on one side than on the opposite side. The teeth are spaced relatively far apart within the rows.

Patent application EP-A1-1 342 428 describes a mascara comb comprising rows of teeth that extend in four different directions.

In U.S. Pat. No. 4,403,624, all of the bristles of the applicator are parallel to one another on one side thereof.

Application FR 2 906 115 describes an injection-molded brush having an envelope surface that is substantially spherical.

The invention seeks to improve still further applicators for applying a composition to the eyelashes or the eyebrows, in particular in terms of the ability of the teeth to penetrate into the eyelashes, to smooth the composition on the eyelashes, and to separate said eyelashes.

The invention also seeks to enable the user to be able to achieve various makeup effects depending on her needs.

In exemplary embodiments of the invention, the applicator for combing the eyelashes and/or the eyebrows, and/or for applying a cosmetic, makeup, or a care product thereto, comprises a molded applicator member that comprises:

an inner core that is elongate along a longitudinal axis, and comprising opposite first and second portions that each extend along the longitudinal axis; and a plurality of rows of teeth, the rows extending along the longitudinal axis of the applicator member, with first rows and second rows of teeth extending from the first and second portions of the core respectively;

at least half the teeth of at least two consecutive first rows, better two third, better all of the teeth differing from at least half of the teeth of at least two consecutive second rows, better two third, better all of the teeth, in their thickness.

By "two consecutive rows of teeth", it is to be understood two rows of teeth, in particular two longitudinal rows of teeth, which follow one another when rotating about the longitudinal axis of the core, which may be rectilinear or curved.

In exemplary embodiments of the invention, the applicator for combing the eyelashes and/or the eyebrows, and/or for applying a composition to the eyelashes and/or the eyebrows, comprises a molded applicator member comprising:

an inner core that is elongated along a longitudinal axis, having opposite first and second portions, each extending along the longitudinal axis;

first rows of teeth extending from the first portion; and second rows of teeth extending from the second portion;

at least half of the teeth, better two third, better all of the teeth, carried by the first portion having a thickness $e_1$ and a length $l_1$, and at least half of the teeth, better two third, better all of the teeth, carried by the second portion having a thickness $e_2$ and a length $l_2$, with $e_1 \neq e_2$. Furthermore, the teeth of each portions may differ by their length, having $l_1 \neq l_2$ or by the number of teeth in the row, or by the spacing of the teeth in a row.

In exemplary embodiments of the invention, the applicator for combing the eyelashes and/or the eyebrows, and/or for applying a composition to the eyelashes and/or the eyebrows, comprises a molded applicator member comprising:

a core extending along a longitudinal axis having opposite first and second portions, each extending along the longitudinal axis;

first rows of teeth extending longitudinally from the first portion; and second rows of teeth extending longitudinally from the second portion;

at least half of the first rows of teeth, better at least two third, better ¾ or even ⅘ of the first rows, having a number of teeth per row that differs from the number of teeth per row of at least half of the second rows, better at least two third, better ¾ or even ⅘ of the second rows.

In these examples, all of the first rows carried by the first portion may have the same number of teeth each and all of the second rows carried by the second portion may likewise have the same number of teeth each, the number $n_1$ of teeth in the first rows being different from the number $n_2$ of teeth in the second rows. For example, $n_1/n_2 \geq 1.3$, better $n_1/n_2 \geq 1.5$, or $n_1/n_2 \geq 1.8$, or even 2.

Within each row supported by the first or second portion, the teeth may be substantially touching, the spacing between two consecutive teeth being less than or equal to 0.1 mm, for example. The spacing corresponds to the smallest gap between the outside surfaces of two consecutive teeth at their bases.

The teeth may be touching, the spacing being substantially equal to zero.

Each row of teeth may have teeth that are in straight-line alignment. In a variant, each row of teeth has a succession of teeth in a staggered configuration.

In exemplary embodiments of the invention, the applicator for combing the eyelashes and/or the eyebrows, and/or for applying a composition to the eyelashes and/or the eyebrows, comprises a molded applicator member comprising:

a core that is elongated along a longitudinal axis, having opposite first and second portions, each extending along the longitudinal axis;

first rows of teeth extending from the first portion; and second rows of teeth extending from the second portion;

the number $m_1$ of teeth carried by the first portion being greater than the number $m_2$ of teeth carried by the second portion, preferably with $m_1/m_2$ greater than or equal to 1.3, better $m_1/m_2$ greater than or equal to 1.5, better still $m_1/m_2$ greater than or equal to 1.75 or even 2.

By way of example, the first rows of teeth may have more teeth per row than the second rows. The first rows of teeth may have teeth of a thickness that is different from the thicknesses of the teeth of the second rows.

In exemplary embodiments, the applicator member may be deprived of any axis of symmetry.

In exemplary embodiments of the invention, the applicator for combing the eyelashes or the eyebrows and/or for applying a composition thereto comprises a molded applicator member that does not have any axis of symmetry, and that comprises:

an inner core that is elongate along a longitudinal axis, and comprising opposite first and second portions that each extend along the longitudinal axis, and a plurality of rows of teeth, the rows extending along the longitudinal axis of the applicator member, with first rows and second rows of teeth extending from the first and second portions of the core respectively;

the teeth of the first rows differing from the teeth of the second rows in at least their shape, length, thickness, material, hardness, spacing in the row, and/or orientation in the row.

For each of the portions, the teeth may extend outwards in at least three different directions.

In a manner that is general for all of the applicator members, the core need not carry any rows of teeth other than the first and second rows.

In embodiments of the invention, the majority or even ⅔, ¾ or even ⅘, or even all of the teeth extending from the first portion differ from the majority or even ⅔, ¾ or even ⅘, or even all of the teeth extending from the second portion in at least one of the following characteristics: shape, length, thickness, material, hardness, spacing within the row, and/or orientation in the row.

The applicator of the invention makes it possible to apply the composition with the first portion or the second portion, as a function of the desired makeup effect, or else to apply the composition with one of the portions and to comb the eyelashes or the eyebrows with the other portion. It is thus possible to select the portion to use as a function of the makeup step, namely coating the eyelashes with composition, or separating, extending, or curling the eyelashes. Using a single applicator, a wide variety of different makeup effects may be obtained.

In general manner, the term "longitudinal axis" of the core should be understood as the line that joins the centers of gravity (barycenters) of the cross-sections of the core. In some circumstances, the longitudinal axis may be a central axis, or even an axis of symmetry for the core, in particular when the core presents a cross-section that has the general shape of a regular polygon or a circle. The longitudinal axis may be rectilinear or curved. The core may be central.

The core is inside the rows of teeth and may be centered or off-center relative to the rows of teeth. All of the teeth extend outwards from the core, all around the core.

In general, the term "portion of the core" is used to mean a longitudinal portion of the core extending angularly, continuously around the longitudinal axis, e.g. over about 180°, or over an angular sector, e.g. lying in the range 150° to 210°. The first and second portions of the core may optionally be symmetrical relative to each other, with symmetry that is axial or relative to a plane. The first and second portions of the core may be defined by a plane comprising the longitudinal axis of the core, e.g. a midplane for the core, which may be a midplane of symmetry for the core. The core may optionally present opposite side surfaces having no teeth. Each side surface may extend between one of the two outermost first rows from amongst all of the first rows and one of the two outermost second rows from amongst all of the second rows. Each side surface may extend angularly over at least 60°, or 45°, or 30°, around the longitudinal axis of the core.

More generally, the term "tooth" is used to designate an element that projects individually, the term being synonymous with "bristle" in the context of the present invention. The teeth may be made by molding a thermoplastic material, e.g. the same material as is used for the portion of the core carrying it.

In general, the applicator may be non-symmetrical about a midplane situated between the first and second rows.

The applicator member may be molded in a single material. The first and second portions of the core may thus be made using the same material, or in a variant using different materials, and in particular materials of different colors, thereby making it easier to identify the portion being used, if so desired by the user. The two materials may both belong to the same family of polymers. By way of example the materials may have the same chemical nature but present different hardnesses. For example, the two materials may both be polyester thermoplastic elastomers, e.g. under the trademark Hytrel® or polyether block amide under the trademark Pebax®. When the applicator member is made using two materials, these materials may for example present mechanical properties that are different, in particular in terms of hardness, one of the materials being softer than the other, for example, or the materials may be of different colors. The material of one portion of the core or the other, or of both portions, may present hardness that is different from the hardness of the teeth.

The teeth of the first rows of teeth and the teeth of the second rows of teeth may be made out of the same material, or, in a variant, they may be made out of different materials.

The teeth of the first rows of teeth and the first portion of the core may be made out of the same material. The teeth of the second rows of teeth and the second portion of the core may be made out of the same material. The teeth of the first rows of teeth may be made out of a material that is different from at least a fraction of the first portion of the core.

At least one of the first portion and of the second portion may present a cross-section that is substantially constant along the longitudinal axis, in particular at least over a fraction of the length of the applicator member.

In a variant, at least one of the first portion and of the second portion may present a cross-section that varies along the longitudinal axis.

Over at least a fraction of their length, the core and/or portions of the core may present a cross-section of shape selected from the following list: circular; semi-circular; elliptical; semi-elliptical; polygonal; triangular; square; rectangular; pentagonal; hexagonal; octagonal, and semi-polygonal. The shape may vary along the longitudinal axis of the core.

The invention also provides an applicator in which the ratio of a greatest transverse dimension of the first portion of the core over a greatest transverse dimension of the second portion lies in the range 0.5 to 2, better in the range 0.7 to 1.4, better still in the range 0.8 to 1.3. As a result, for teeth having lengths that are relatively close or equal, an envelope surface of the applicator member is relatively smooth.

The first rows of teeth may be images of each other in rotation about the longitudinal axis of the core, e.g. by turning two adjacent rows through the same angle, or in a variant by turning through an angle that is not always constant, but that is a multiple of a given angular pitch, for example. The second rows of teeth may be images of one another by rotation about the longitudinal axis of the core, through an angle that is constant or otherwise.

The applicator member may have rows of teeth of length as measured from the core that is less than 1.8 mm for example. The applicator may also have rows of teeth of greater length, as measured from the core, e.g. lying in the range 1.35 mm to 3 mm. Rows of teeth of length less than or equal to 1.8 mm and rows of teeth lying in the range 1.35 mm to 3 mm may extend from the same portion of the core. It is also possible to have only teeth of length less than or equal to 1.8 mm extending from the first portion of the core and teeth of greater length, lying in the range 1.35 mm to 3 mm extending from the second portion of the core.

In exemplary embodiments of the invention, the applicator thus may comprise:

- a core that is elongate along a longitudinal axis, having opposite first and second portions extending along the longitudinal axis;
- rows of teeth having lengths less than 1.8 mm, supported by the first portion; and
- rows of teeth of length greater than 1.8 mm, supported by the second portion.

In general manner, the ends of the teeth of the first rows of teeth may define a first half envelope surface of the applicator, the ends of the teeth of the second rows of teeth defining a second half envelope surface of the applicator, the first and second half envelope surfaces having shapes that are different, for example.

One of the two half envelope surfaces of the applicator may have a greatest transverse dimension, e.g. a diameter, that is less than 5.5 mm. The other of the two half envelope surfaces may have a greatest transverse dimension, e.g. a diameter, lying in the range 5.7 mm to 10 mm, e.g. about 6.5 mm to 7 mm.

At least one row of teeth may be disposed on the core in a manner that is different from another row of teeth, the two rows differing in at least one of the following ways: the length of the teeth; the spacing of the teeth in the row; the implantation of the teeth in the row; the number of teeth in the row; the thickness of the teeth measured perpendicularly to their long direction; the material forming the teeth; the shape of the teeth; the shape of the cross-section of the teeth.

The teeth of the first rows of teeth may be spaced apart by a first spacing, the teeth of the second rows of teeth may be spaced apart by a second spacing, the first spacing being different from the second spacing, in particular smaller than the second spacing.

The teeth of the first rows of teeth may have thickness that is less than the thickness of the teeth of the second rows of teeth. The widths of the teeth are measured at the same distance from the core, e.g. at no distance from the core, i.e. at the base of the teeth.

The thickness of a teeth may correspond to a greatest transversal dimension of the teeth, measured perpendicularly to the longitudinal axis of the teeth.

The teeth of the first rows of teeth may be thinner than the teeth of the second rows, and they may be made out of a material that is harder than the material of the teeth of the second rows. Conversely, the teeth of the first rows may be thinner, and they may be made out of a material that is more flexible than the material of the teeth of the second rows.

The teeth of the first rows of teeth and the teeth of the second rows of teeth need not be disposed within their rows in the same manner relative to the core.

The majority of the teeth of the applicator may have thickness lying either in the range 0.2 mm to 0.5 mm, better in the range 0.2 mm to 0.45 mm, e.g. in the range 0.2 mm to 0.39 mm, or else in the range 0.5 mm to 0.6 mm. The term "thickness of a tooth" is used to designate the greatest cross-section of the tooth. In the first instance, i.e. when the thickness lies in the range 0.2 mm to 0.5 mm, the teeth are relatively fine and may also be relatively flexible when the material from which they are made is a flexible material. In the second instance, i.e. when the thickness lies in the range 0.5 mm to 0.65 mm, the teeth are thicker and may be more rigid.

In an exemplary embodiment, the thickness of the teeth of first rows may be of the order of 0.3 mm, and the thickness of the teeth of second rows may be of the order of 0.55 mm.

The thickness be of the teeth of the first rows and of the second rows may differ from at least 20%, better at least 30%, better at least 40%, or even 50%.

The thickness of the teeth could be selected as a function of the type of makeup effect desired and/or the nature of the eyelashes to be treated and/or the rheology of the composition to be applied, for example.

The applicator may comprise only teeth having thickness lying in the range 0.2 mm to 0.5 mm, or, in a variant, only teeth having thickness that is strictly greater than 0.5 mm and less than 0.65 mm, or it may even comprise both. By way of example, teeth having a certain thickness may be mixed with teeth having another thickness, or, in a variant, teeth having a certain thickness may be grouped together in one portion of the applicator member, while teeth having another thickness are grouped together in another portion of the applicator member, e.g. opposite from the first portion. The teeth of length lying in the range 0.5 mm to 1.8 mm may be distributed uniformly over the applicator member or they may be grouped together in at least one region thereof.

In some embodiments, the majority of the teeth of the applicator may have a length lying in the range 0.5 mm to 1.8 mm, or even in the range 0.5 mm to 1.49 mm, e.g. in the range 0.5 mm to 0.99 mm. More than half of the teeth of one of the portions may have a length as defined above, better at least 60%, or even 70%, better still 80% of the teeth of one of the portions. The teeth having a length as defined above may be situated in the central portion of the applicator member, for example.

The applicator may comprise rows of small teeth having a maximum length as measured from the core of 1.75 mm, for example. The applicator may also have rows of large teeth of greater length as measured from the core, e.g. lying in the range 1.35 mm to 3 mm. The minimum length of the large teeth may be at least 0.25 mm greater than the maximum length of the small teeth. The first portion of the core may support only such small teeth and the second portion of the core may support only such large teeth.

The term "length of tooth" is used to designate the distance measured along the long direction of the tooth between the free end of the tooth and its base via which it is connected to the core. The length of a tooth is measured from the core of the applicator member.

All of the teeth of a portion of the applicator member may have the same length, except possibly the teeth situated in the vicinity of each of the two ends of the applicator member.

The applicator may comprise between 150 and 500 teeth, for example.

As indicated above, the teeth may be disposed in rows extending along the longitudinal axis of the core. The term "row" is used to designate a succession of teeth that are generally situated on the same side of the core, and that succeed one another along the core. By way of example, the applicator may comprise at least three rows of teeth extending along the longitudinal axis, e.g. between 3 and 20 rows of teeth, better between 4 and 18 rows, better still between 6 and 10 rows. By way of example, the applicator may comprise 16 rows of teeth.

All of the rows of teeth supported by the first portion may comprise teeth that are substantially touching within a given row. The same may apply to the teeth of the second rows carried by the second portion.

Each portion of the core may comprise at least three rows of teeth extending along the longitudinal axis, both portions of the core having the same number of rows. The first or second portion may comprise between 3 and 8 rows of teeth, for example.

A row of teeth extending along the longitudinal axis may have at least three teeth of the same length.

Within a row of teeth, the number of teeth may lie in the range about 6 to 60, in particular in the range about 10 to 50.

At least one row of teeth may extend along a rectilinear axis that may optionally be parallel to the longitudinal axis of the core.

At least two teeth of at least one row may present lengths that are different or identical.

At least two teeth of at least one row may present shapes that are different or identical.

At least one tooth of at least one row may present a general shape that tapers towards its free end.

At least one tooth may be of tapered, frustoconical, or pyramid shape.

At least one tooth of one of the rows may present a shape that is different from a tooth of another row.

When the core is observed along its longitudinal axis, two teeth of a row may extend at their bases in directions that form a first angle between them, and two teeth of another row may extend at their bases in directions that form a second angle between them, the first and second angles being equal or different.

Within each row, the teeth may be spaced-apart evenly along the longitudinal axis of the row, or they may be grouped together in groups of two or more teeth, the spacing between the teeth of one group along the longitudinal axis of the row being less than the spacing between two adjacent groups of teeth of said row.

By adapting the shape of the teeth and their spacing, it is possible to establish cavities of greater or smaller size between the teeth, such cavities being suitable for being loaded with composition. It is thus possible to make a row of teeth that is capable of being loaded with a substantial quantity of composition, but without the row of teeth losing its capacity to grip the eyelashes.

Two rows of teeth may be made out of different respective materials. In addition, the teeth of a single row of teeth may be made out of different materials, e.g. of different hardness or color.

At least two successive teeth of a row may optionally be touching at their bases, all of the teeth of the row respectively being non-touching or touching at their bases. The spacing between the teeth, measured at the bases of the teeth and not between the axes of the teeth, may lie in the range 0 to 1.2 mm within a row, e.g. in the range 0.01 mm and 1 mm. When the teeth are touching at their base, the spacing between the teeth measured at the base of the teeth is zero.

When the applicator is observed perpendicularly to its longitudinal axis, at least two teeth may define a V-shaped groove.

Teeth of one row and teeth of another row may extend in different directions.

The teeth of a row may have bases that are substantially in alignment, namely that the centers of the bases of three consecutive teeth are situated substantially on a single straight line.

The core may comprise a plurality of longitudinal faces, and the applicator may comprise rows of teeth, each extending from one of the longitudinal faces of the core.

The teeth of at least one row may be connected to the corresponding longitudinal face of the core on the same side of a middle longitudinal line of the longitudinal face of the core.

The teeth may have bases that are not centered on the longitudinal face of the core to which they are connected.

The bases of the teeth in a row may be in alignment, or they may be disposed in a staggered configuration. For a staggered configuration, a plurality of consecutive teeth of the row may be offset at least in part, alternately on opposite sides of a geometrical separation surface, which may be plane. The consecutive teeth may be offset completely, alternately on opposite sides of the geometrical separation surface. The term "offset completely" should be understood as the geometrical separation surface not passing through the teeth, being a tangent to said teeth at the closest.

All of the teeth of each row may be offset alternately on opposite sides of a geometrical separation surface that is associated with the row. In a variant, the teeth may be offset on opposite sides of the separation surface, not alternately, but in groups of teeth, e.g. in groups of two or three teeth.

Still in a variant, the teeth may be offset not on opposite sides of a surface, but disposed in a pattern that is repeated along the longitudinal axis of the row, each pattern comprising three or four teeth, for example, in alignment along a line that extends obliquely relative to the axis of the row, for example.

Two consecutive teeth of a row need not be images of each other that are merely shifted in translation, in particular when the cross-sections of the teeth are non-circular in shape.

At least two consecutive teeth of a row of teeth may have first faces both having a common first shape, e.g. plane, at least at the bottom portion of the tooth, for example, and second faces both having a common second shape, e.g. not plane, in particular rounded. The first faces may all face in the same direction around the core, i.e. they may all face clockwise or counter-clockwise, when the core is observed along its longitudinal axis.

The applicator may comprise rows of teeth within which the teeth present first faces having the same shape, e.g. plane faces, alternate plane faces facing in opposite directions along the longitudinal axis of the core. Such a disposition of the teeth can make them easier to fabricate by using mold shells having join planes that occupy longitudinal midplanes of the rows.

The first faces of the teeth, in particular when they are plane, may be connected substantially perpendicularly to the corresponding face of the core, at least for some teeth in the row. At least one tooth, or even all of the teeth, may present a plane face that is parallel to their long direction.

The cross-section of at least one tooth, or even of each tooth, may be of substantially semi-circular or semi-elliptical in shape, e.g. D-shaped, or it may be of still some other shape. At least one tooth may present a cross-section that is: circular; elliptical; polygonal, in particular triangular, square, rectangular, octagonal, parallelogram-shaped, lozenge-shaped; or oval. This may impart thereto a better capacity to deform in a preferred direction. At least one tooth may present at least one portion in relief. Such a characteristic may improve the adherence of the composition to the tooth. Without changing in shape, the cross-section of the tooth may decrease on going away from the core, e.g. over more than half of the length of the tooth. Two teeth may be of shapes that are different, e.g. of cross-sections that are different, or of longitudinal sections that are different. At least one tooth may be frustoconical in shape. At least one tooth may be cylindrical in shape.

The teeth may optionally be rectilinear, e.g. each extending along a long axis for the tooth that is rectilinear, or else they may be curved, or they may even be undulating. The term "longitudinal axis of the tooth" is used to mean an axis that passes via the centers of gravity of the cross-sections of the tooth.

The free ends of the teeth may define an envelope surface that may extend along a longitudinal axis that forms a non-zero angle with the longitudinal axis of the core.

The envelope surface may be of greatest transverse dimension, e.g. of diameter, that is substantially constant over at least a fraction of the length of the applicator member.

The envelope surface may be in the shape of a peanut, an American football, frustoconical, or two half-shapes selected from amongst the above-mentioned shapes and fitted together along a diametral plane containing the longitudinal axis of the core, e.g. one portion in the shape of half an American football fitted to a portion that is frustoconical.

Each of the rows of teeth may extend on the core along a longitudinal axis of the row. The longitudinal axis of the row is a central axis for the bases of the teeth of the row, being the straight line passing via the centers of the bases of the teeth for teeth that are rigorously in alignment, or the axis passing via the separation surface for teeth in a staggered configuration.

Since the longitudinal axis of a row is considered at the surface of the core, two longitudinal axes of two successive rows, around the longitudinal axis of the core, may be separated angularly by an angle that is less than 80°, e.g. about 60°, or even less than 50°, e.g. about 45° or less. The distribution of the longitudinal axes of the rows at the surface of the core may be substantially regular, with spacing between them that is substantially constant and equal to a predefined value±20%, better±10%, better still 5%.

The applicator member may comprise a zone having no teeth between two rows of the first portion or of the second portion, these two rows that are supported by the same portion being, for example, spaced apart from each other by a gap that is twice the size of the gap between the other rows carried by the same portion of the core.

Teeth may be situated along the core, around the longitudinal axis of the core, at intervals of about one every 360°/n, for example, with n lying in the range 3 to 20, better in the range 4 to 16, better still in the range 6 to 10.

The applicator member may not comprise a toothless region that extends angularly over more than one eighth of a turn, thereby making it easier to use since the user does not need to orientate the applicator too precisely relative to the eye.

By way of example, the teeth may extend in at least six different directions around the longitudinal axis of the core.

The teeth may extend along a long axis that is perpendicular to the surface of the core to which they are connected, or, in a variant, that is not perpendicular, forming a non-zero angle with the normal to the core at the base of the teeth.

In embodiments of the invention, the teeth are made with the core by molding or by overmolding.

The applicator may be made with a disposition of teeth on the core that makes it easier for the eyelashes to come into contact with the core, which may present a surface state that is perfectly defined, which is not always true of a conventional brush having a twisted core.

In an embodiment of the invention, the eyelashes may be loaded with composition that is in contact with the core. The core may thus participate in active manner in applying composition to the eyelashes, thereby offering more freedom in the choice and the arrangement of the teeth.

At least one tooth of a row may extend, at least at its portion that is connected to the core, or even over its entire length, along a first direction $Z_1$, perpendicular to the longitudinal face of the core to which the tooth is connected, or forming a small angle with the normal, e.g. less than 10°, better 5°. A consecutive tooth of the row may extend from the same face of the core along a second direction $Z_2$, at least at the portion that is connected to the core, or even over its entire length, forming an angle $\alpha$ with the first direction, when the core is observed along its longitudinal axis. All of the teeth of the various rows may be made in this way.

Substantially half of the teeth of a row may extend parallel to the first direction $Z_1$. The angle $\alpha$ between the directions $Z_1$ and $Z_2$ may lie in the range 5° to 80°.

The teeth may be connected perpendicularly to the core or they may be connected at an angle relative to the normal to the core, such that all of the teeth face in the same direction around the core, when the core is observed along its longitudinal axis. The applicator member thus need not have teeth that are oriented in opposite directions around the core. For example, when the core is observed from its distal end, all of the teeth that extend obliquely may be oriented in the clockwise direction.

The core may comprise at least one longitudinal face that is plane. In a variant, the core may comprise at least one longitudinal face that is not plane, e.g. being concave or convex, at least in part.

When observed perpendicularly to its longitudinal axis, the core may present a profile that varies. In particular, the core may present a transverse dimension that reaches a minimum in a central portion of the core, along its longitudinal axis.

At least one tooth, better each tooth of a row or of the applicator, may extend from a corresponding non-plane longitudinal face of the core in a manner that is substantially perpendicular to a plane that is tangential to the core at said tooth. For example, for a cylindrical core of circular cross-section, the teeth may extend radially.

The core may present a longitudinal face that is concave or convex in cross-section, and that has concavity or convexity that may vary along the longitudinal axis of the core.

The core may present at least one face from which teeth extend, the face presenting a width that varies along the longitudinal axis of the core.

The core may present a cross-section that is substantially constant, at least over a fraction of its length. The core may also present a cross-section that varies. The cross-section of the core may pass through an extremum that is substantially mid-way along the core, the extremum being a minimum, for example. This may impart increased flexibility to the core, and makes it possible to define an envelope surface of section that varies along the applicator member, in particular when the teeth in a row are of the same length, at least over a fraction of the length of the applicator member.

In a variant, the length of the teeth may vary along the row, such that the cross-section of the core and the cross-section of the envelope surface of the applicator member defined by the free ends of the teeth are not geometrically similar.

The envelope surface of the applicator member may present, at a first location along the longitudinal axis of the applicator member, a first cross-section that is substantially polygonal, and, at a second location along the longitudinal axis, a second cross-section that is substantially polygonal, at least a first vertex of the first cross-section being connected to at least a second vertex and to a third vertex of the second cross-section via respective edges, the first and second vertices being offset angularly around the longitudinal axis of the applicator member, at least one of the first and second cross-sections being centered on the longitudinal axis of the applicator member.

The core may present a longitudinal face that is twisted. The applicator member may present a helical distribution of the teeth on the core, oriented clockwise or counter-clockwise on going towards the distal end of the applicator member.

The applicator may comprise a single row of teeth per longitudinal face of the core.

The length of the applicator member may lie in the range about 10 mm to 48 mm, in particular in the range 15 mm to 38 mm, or even in the range 20 mm to 35 mm, e.g. being about 27 mm.

The length of the applicator member may be defined as the length of the envelope surface defined by the free ends of the teeth measured along the longitudinal axis. The length of a row, or even all of the rows, may lie in the range about 10 mm to 45 mm, in particular in the range 15 mm to 35 mm, or even in the range 20 mm to 30 mm, e.g. being about 25 mm.

When the core is observed along its longitudinal axis, it is possible to pass from one row to another by turning the core about its longitudinal axis through an integer sub-multiple of 360°, e.g. turning through 360°/n, where n is an integer that lies in the range 3 to 20, for example.

The core may extend along a longitudinal axis that, at at least one point along its length, forms a non-zero angle with the longitudinal axis of a stem to which the core is fastened. The core may be bent where it connects to the stem.

The core may comprise a recess in which there is engaged a support portion, e.g. made of metal or plastics material. The core may be configured to be fastened to the support, or it may be free to turn or to move in translation relative to the support.

In a variant, the portion of the core that supports the teeth may be solid. The core may comprise a housing at one of its ends only, so as to enable it to be fastened to a stem connected to a handle.

The core may have a greatest transverse dimension, measured perpendicularly to its longitudinal axis, e.g. a diameter, lying in the range 1.2 mm to 3 mm.

The teeth may be made integrally with the core, e.g. by molding, in particular by injection-molding. The mold may be formed of a plurality of shells. The number of shells may be equal to the number of rows of teeth.

The applicator member may be formed by mono-injecting material or by over-injecting, preferably using a thermoplastic material, which may be elastomeric. By way of example, it may be made by injection into a mold that is pierced on its sides in such a manner as to form the teeth. The applicator member may also be made by dual-injection, e.g. by injecting two materials simultaneously into a single mold.

The teeth may be made of a material that is more rigid or less rigid than a material that is used to make the stem of the applicator to which the core is connected.

At least one of the core and a tooth may present magnetic properties. By way of example, the magnetic properties may result from a filler of magnetic particles, e.g. of ferrites, that are dispersed in the plastics material of the core and/or of the tooth.

At least one of the core and a tooth may be flocked and/or may comprise a filler for improving sliding, for example.

The applicator may comprise a stem at a first end of which the applicator member is fastened. The core may be constituted by a separate piece that is fitted to the stem of the applicator. The core may be fastened to the stem of the applicator by inserting an endpiece that extends the visible portion of the core into a housing formed at the end of the stem. In a variant, the core may comprise a housing that extends longitudinally, and into which the stem is inserted.

Still in a variant, the core may be made integrally with the stem of the applicator by molding a plastics material.

The core may be made of a plastics material that is more flexible or less flexible than the plastics material that is used to make the stem of the applicator.

By way of example, the diameter of the stem may lie in the range 3 mm to 3.5 mm.

The stem may be connected to a handle at a second end remote from the first, which handle may be configured to close, in leaktight manner, a receptacle containing the composition to be applied. The receptacle may comprise a wiper member that may be adapted to wipe the stem and the applicator member.

The applicator may be free of any metal, thereby making it possible to put it in a microwave oven.

Where appropriate, the core may have a hollow inside, and it may comprise at least one channel via which the composition can pass through the applicator member.

Because of the differences that exist between the rows of teeth carried by the first and second portions, the applicator member defines two faces (also referred to as sides) having properties that differ in terms of how composition is applied to the eyelashes, and the handle member may be indexed relative to said faces so as to make it easier for the user to select the face that is to be used. For example, the applicator member presents a shape that is not entirely a body of revolution, e.g. that comprises a flat, or that comprises a visual marker, e.g. a printed marker, enabling the faces to be distinguished from each other.

The invention also provides a packaging and applicator device for applying a composition to keratinous fibers, in particular the eyelashes or the eyebrows, the device comprising an applicator as defined above, and a receptacle containing the composition. The handle of the applicator may constitute a closure cap for closing the receptacle.

The composition may be a mascara, e.g. a water-resistant mascara.

The invention also provides a method of applying makeup to the eyelashes or the eyebrows by means of an applicator as defined above.

The invention can be better understood on reading the following detailed description of non-limiting embodiments thereof, and on examining the accompanying drawings, in which:

FIG. 1 is a diagrammatic and fragmentary longitudinal section view in elevation showing an example of a device made in accordance with the invention;

FIG. 2 is a side view of the FIG. 1 applicator member shown in isolation;

FIG. 3 is a view as seen looking along arrow III in FIG. 2;

Figure 64:
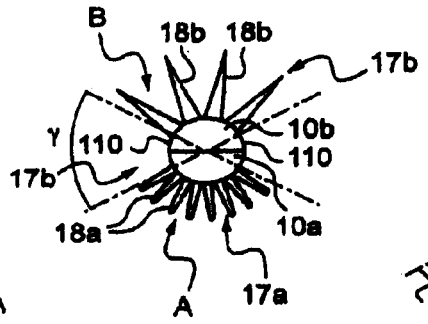
Figure 65:
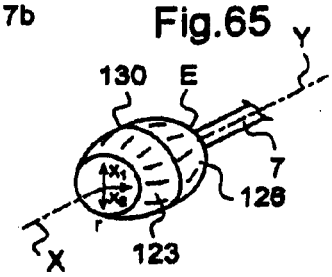
Figure 66:
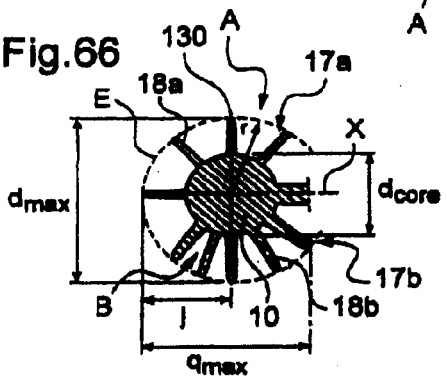
Figure 67:
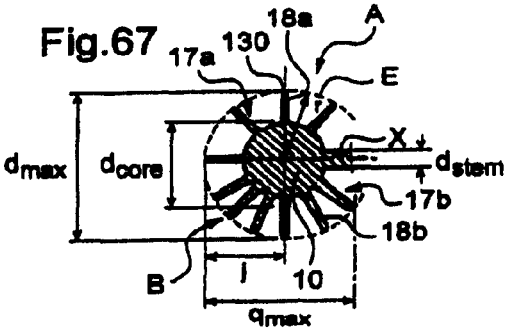
Figure 68:
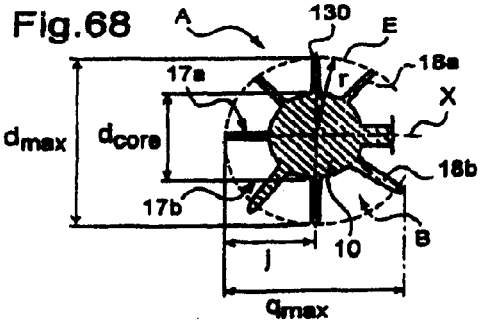
Figure 69:
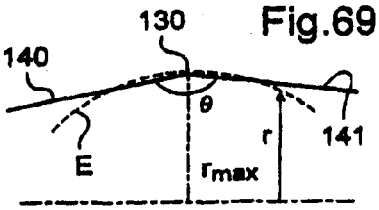
Figure 72:
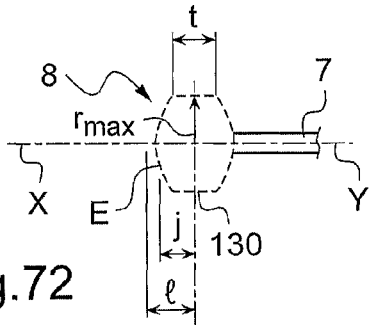
Figure 73:
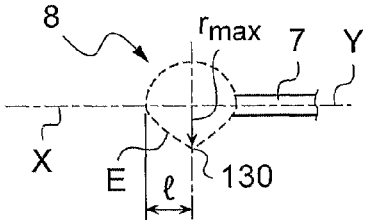
Figure 74:
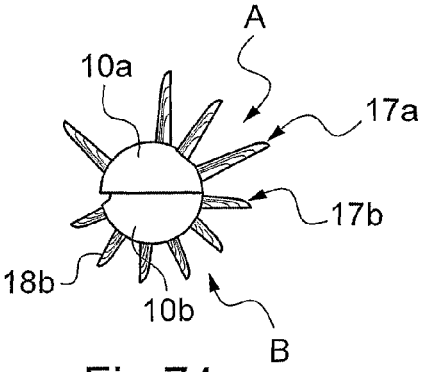
Figure 75:
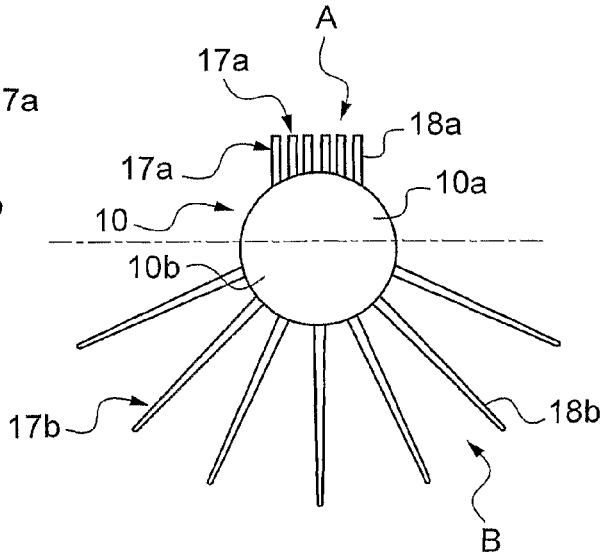

FIGS. 4 & 5, and 6 & 7, and 8 & 9 are views similar to FIGS. 2 and 3 of variant embodiments;

FIGS. 10 to 19 are diagrammatic and fragmentary cross-sections of variant embodiments;

FIGS. 20, 21, 22*a*, 23*a*, 23*c*, 24, 25, 26*a*, and 26*b* are diagrammatic and fragmentary views showing arrangements of teeth;

FIGS. 22, 23, and 23*b* are fragmentary perspective views of variant embodiments;

FIG. 26 is a diagrammatic and fragmentary side view of a variant embodiment;

FIGS. 27 to 31 are cross-sections of teeth;

FIG. 32 is a perspective view of a variant embodiment;

FIG. 33 is a view similar to FIG. 2 showing another variant;

FIGS. 34 to 40 are diagrams of envelope surfaces of other variant embodiments;

FIG. 41 is a fragmentary longitudinal section of a variant embodiment;

FIGS. 42 to 44 show variant embodiments of teeth;

FIG. 54 is a diagrammatic and fragmentary cross-section of a variant embodiment of the wiper member;

FIGS. 46 and 47 show details of variant embodiments of the stem;

FIGS. 49 and 50 are views analogous to FIGS. 20 and 21, showing examples of arrangements of teeth within a row;

FIGS. 51 and 52 are diagrams showing other arrangements of teeth within a row;

FIG. 53 shows the possibility of having different numbers of teeth on either side of the core;

FIGS. 54 to 56 show examples of envelope surfaces;

FIG. 57 is a cross-section on LVII of FIG. 56;

FIGS. 58 to 63 show other examples of envelope surfaces;

FIG. 64 is a diagrammatic cross-section of a variant embodiment of the applicator member;

FIG. 65 is a diagram showing the envelope surface of a variant embodiment of the applicator member;

FIGS. 66 to 68 are diagrammatic longitudinal sections showing various embodiments of the applicator member;

FIG. 69 shows an embodiment detail;

FIGS. 70 to 73 show other examples of envelope surfaces for the applicator member; and FIGS. 74 and 75 are face views of various embodiments of the applicator member.

FIG. 1 shows a packaging and applicator device made in accordance with the invention, the device comprising an applicator 2 and an associated receptacle 3 containing a composition P for application to the eyelashes and/or the eyebrows, e.g. mascara or a care product.

By way of example, the applicator 2 of the invention makes it possible to use a water-resistant mascara.

In the embodiment under consideration, the receptacle 3 comprises a threaded neck 4, and the applicator 2 comprises a closure cap 5 that is arranged to be fastened on the neck 4 so as to close the receptacle 3 in leaktight manner when not in use, the closure cap 5 also constituting a handle for the applicator 2.

The applicator 2 comprises a stem 7 of longitudinal axis Y, which stem is connected at its top end to the closure cap 5, and at its bottom end to an applicator member 8.

The receptacle 3 also comprises a wiper member 6 that is inserted in the neck 4.

In the embodiment under consideration, the wiper member 6, that can be of any type, comprises a lip 9 that is arranged to wipe the stem 7 and the applicator member 8 while the applicator 2 is being removed from the receptacle 3. The lip 9 defines a wiper orifice of diameter that is adapted to the diameter of the stem.

In the embodiment shown, the stem 7 presents a cross-section that is circular, but it would not be beyond the ambit of the present invention for the stem 7 to present some other section, the cap 5 thus possibly being fastened on the receptacle 3 other than by screw-fastening, if necessary. The wiper member 6 could be adapted to the shape of the stem 7 and to the shape of the applicator member 8, where appropriate.

In the embodiment under consideration, the longitudinal axis Y of the stem 7 is rectilinear and coincides with the longitudinal axis of the receptacle 3 when the applicator 2 is in place thereon, but would not be beyond the ambit of the present invention for the stem 7 to be non-rectilinear, e.g. forming a bend.

Where appropriate, the stem 7 can comprise an annular narrowing at its portion that comes to be positioned facing the lip 9 of the wiper member 6, so that said wiper member is not mechanically stressed unduly during storage.

With reference to FIGS. 2 and 3, it can be seen that the applicator member 8 comprises a central core 10 of elongate shape, extending along a longitudinal axis X.

The core 10 comprises a first portion 10*a* and a second portion 10*b* that is opposite the first portion, each of the portions 10*a* and 10*b* extends along the longitudinal axis X of the core.

In the embodiment under consideration, over the majority of its length, the core 10 presents a cross-section that is polygonal, having sides that define longitudinal faces 15. In the embodiment described, the faces 15 are plane. The longitudinal axis X is central.

By way of example, the longitudinal faces 15 are six in number, the cross-section of the core being substantially hexagonal. In the embodiment under consideration, each of the portions 10*a*, 10*b* occupies half of the core, with each defining three longitudinal faces 15, the portions 10*a* and 10*b* being symmetrical to each other about a mid-plane containing the longitudinal axis X of the core.

In the embodiment shown, a single row 17 of teeth 18 is connected to each of the longitudinal faces 15.

In the embodiment under consideration, the teeth 18 are made integrally with the core 10 by molding thermoplastic material.

In order to mold the applicator member, it is possible to use a thermoplastic material that is optionally relatively rigid, e.g. styrene-ethylene-butylene-styrene (SEBS); a silicone rubber; latex rubber; butyl rubber; ethylene-propyleneterpolymer rubber (EPDM); an acetate; a styrene; a nitrile rubber; a acetate-based polymer; a styrene-based polymer; a thermoplastic elastomer; a polyester, polyamide, polyethylene, or vinyl elastomer; a polyolefin such as polyethylene (PE) or polypropylene (PP); polyvinyl chloride (PVC); ethyl vinyl acetate (EVA); polystyrene (PS); polyethylene terephthalate (PET); polyoxymethylene (POM); polyamide (PA); or polymethyl methacrylate (PMMA). In particular, it is possible to use materials known under the trade names Hytrel®, Cariflex®, Alixine®, Santoprene®, Pebax®, this list not being limiting.

In another example, the half of the applicator member which corresponds to the first portion and to the teeth supported thereby can be molded in a first material that is Hytrel® of hardness 47 on the Shore A scale (ShA), while the other half is molded out of Hytrel® of hardness 63 ShA, these two materials being of different colors, for example.

Where appropriate, the applicator member 8 can also be made by molding a metal.

The teeth and the core can be made out of different materials.

At its distal end 12, the applicator member 8 can comprise a head that tapers forwards so as to make it easier to put the applicator 2 back into the receptacle 3. The height of the teeth 18 can decrease on going towards the head 12, along a distal transition portion 13*a*, as shown in FIG. 2.

The height of the teeth 18 can also decrease along a proximal transition portion 13*b* on going towards the stem 7, so as to make it easier for the applicator member 8 to pass through the wiper member 6 while the applicator 2 is being removed.

The head 12 can be circularly symmetrical, or it can comprise radial fins, as shown in FIG. 2.

In the embodiment under consideration, the core 10 is extended from its proximal end by a cylindrical endpiece 14 that enables it to be fastened onto the stem 7. In particular, fastening can be performed by force-fitting, snap-fastening, adhesive, heat-sealing, or crimping in a housing provided at the end of the stem. In a variant, the stem can be inserted into a housing provided in the core.

The core 10 can also be molded integrally with the stem 7 or it can be made with a housing into which the stem 7 is inserted.

The rows 17 of teeth 18 comprise first rows 17*a* of teeth 18*a* that extend from the first portion of the core 10*a*, and second rows 17*b* of teeth 18*b* that extend from the second portion 10*b* of the core. The rows 17*a* define a first application face A of the applicator member, and the rows 17*b* define the opposite second face B.

In the embodiment described, the teeth 18*a* and 18*b* of the first and second rows 17*a*, 17*b* differ in particular in their length, the teeth 18*a* being longer than the teeth 18*b*. In addition, the rows 17*a* and 17*b* also differ in the spacing of the teeth 18*a*, 18*b* in the row, the teeth 18*a* being more spaced apart in the rows 17*a* than the teeth 18*b* in the rows 17*b*. As a result, the applicator member comprises a greater number of teeth 18*b* than teeth 18*a*, although the number of first rows 17*a* is equal to the number of second rows 17*b*.

A row of teeth be configured as described in US 2008/0023020.

An example of a configuration of a row 17 of teeth 18 is described more precisely below, the description applying equally well, in an embodiment of the invention, to the rows 17*a* of the first portion 10*a*, as to the rows 17*b* of the second portion 10*b*.

Each row 17 of teeth 18 comprises a first set 20 of first teeth that are connected to the corresponding face 15 of the core 10 while forming an angle $\alpha_{Z1}$ relative to the normal thereto, and a second set 30 of teeth that are connected to the face 15 obliquely, forming an angle $\alpha_{Z2}$ relative to said normal.

The teeth 18 of the first set 20 of teeth are straight, extending along a direction $Z_1$ that is substantially perpendicular to the face 15, the angle $\alpha_{Z1}$ being relatively small, e.g. less than 10°, or even less than 5°.

The teeth 18 of the second set 30 of teeth are also straight in the embodiment under consideration, extending along a direction $Z_2$, forming an angle $\alpha$ with the direction $Z_1$. By way of example, the angle $\alpha$ can lie in the range 20° to 80°.

In FIG. 3, it can be seen that each row comprises teeth having a face that is connected perpendicularly to the corresponding longitudinal face 15.

In the embodiment described, the teeth 18 of each row 17 are disposed in a staggered configuration. Two consecutive teeth 18 of each row 17 are offset alternately on opposite sides of a separation surface S, the surface S being a bisector plane of the angle $\alpha$.

The teeth of the first set 20 are disposed on one side of the separation surface S, while the teeth of the second set 30 are disposed on the other side of said separation surface, when the core 10 is observed along its longitudinal axis.

Within each row 17, the bases of the teeth of the first set 20 and of the second set 30 are not in alignment, since they are respectively situated entirely on opposite sides of the separation surface S.

In the embodiment shown, the teeth of the first set 20 and of the second set 30 do not overlap, when the applicator member is observed from the side along a direction that is perpendicular to the axis X, as shown in FIG. 2.

In addition, the directions $Z_1$ and $Z_2$ of the teeth 18 of the first and second sets 20 and 30 of teeth do not intersect the longitudinal axis X of the core, the teeth being excentric relative to the axis.

It can be seen in FIGS. 2 and 3 that each tooth 18 of the first set 20 of a row 17 can be associated with a respective tooth of the first set 20 of another row 17, substantially occupying the same axial position along the axis X of the core, the passage from one tooth to another being performed by turning about the axis X through a sub-multiple of 360°, in this event 60°. The same applies for each tooth 18 of the second set 30.

The oblique teeth 18 of the various rows face in the same direction around the core, i.e. the clockwise direction in FIG. 3.

Figure 4:
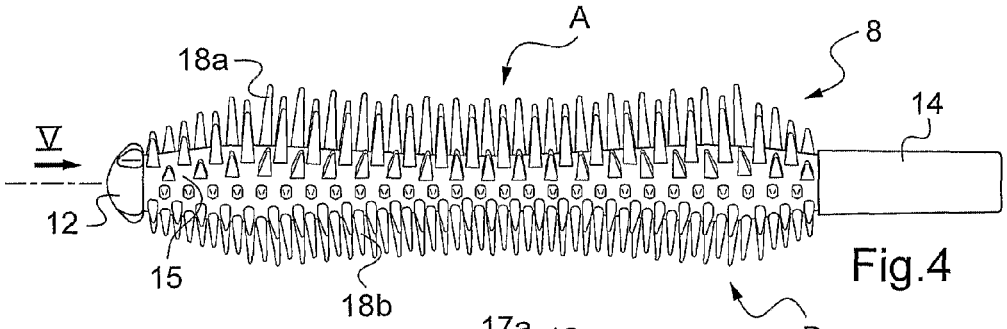

Naturally, it would not be beyond the ambit of the present invention if this were otherwise, and if the faces 15 of the core were, for example, concave in the central portion, as shown in FIG. 4.

In this embodiment, the core 10 comprises longitudinal faces 15 that are concave at least in part, the concave shapes being centered on a mid-plane of the core 10, e.g. intersecting said core substantially half-way along.

The concave shapes of the longitudinal faces 15 can be formed by a narrowing of the cross-section of the core 10.

In addition, the greatest transverse dimension D of the applicator member may be less than or equal to 7 mm, better less than or equal to 6 mm, better less than or equal to 5.7 mm.

In this embodiment, all of the teeth also have the same length, at least in a central portion of the applicator member, such that, also in a central portion of the applicator member, the envelope surface is concave.

Figure 5:
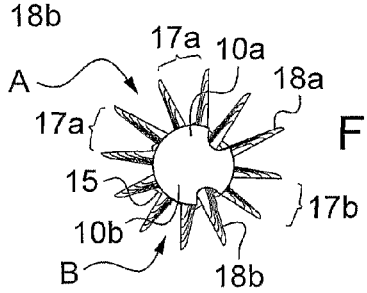

The teeth 18*a* and the teeth 18*b* of the first portion 10*a* and second portion 10*b* of the applicator member 8 shown in FIGS. 4 and 5 also differ in their length and in their spacing, as in the embodiment shown in FIGS. 1 to 3, the teeth 18*a* being longer and spaced further apart than the teeth 18*b*.

Figure 6:
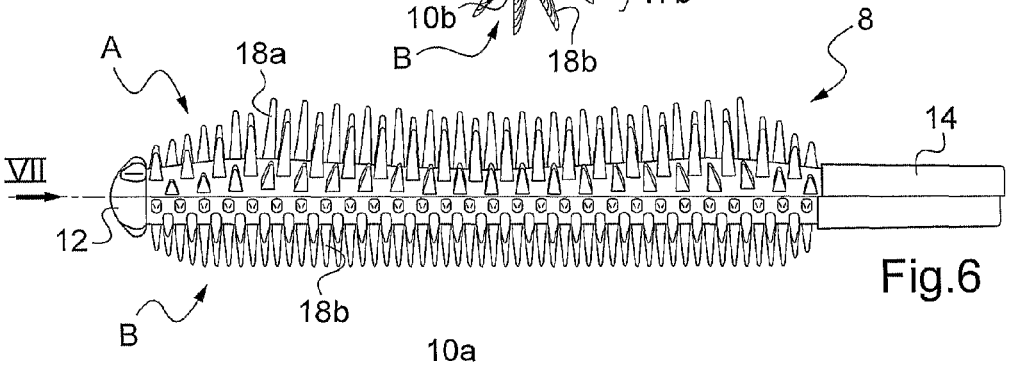
Figure 7:
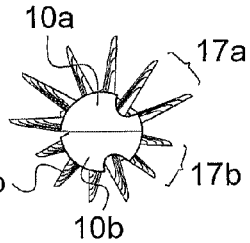

In the embodiments in FIGS. 6 & 7 and 8 & 9, the two portions 10*a* and 10*b* differ from each other in the way their faces 15 are concave, if at all, the faces 15 of the portion 10*a* of the embodiment in FIGS. 6 and 7 being concave, while the faces 15 of the portion 10*b* are plane. The teeth 18*a* are longer and are spaced further apart than the teeth 18*b* of the second portion 10*b*. For example, the first portion 10*a* of the embodiment in FIGS. 6 and 7 can correspond to the first portion 10*a* of the embodiment in FIGS. 4 and 5, and the second portion 10*b* of the embodiment in FIGS. 6 and 7 can correspond to the second portion 10*b* of the embodiment in FIGS. 1 to 3.

Figure 8:
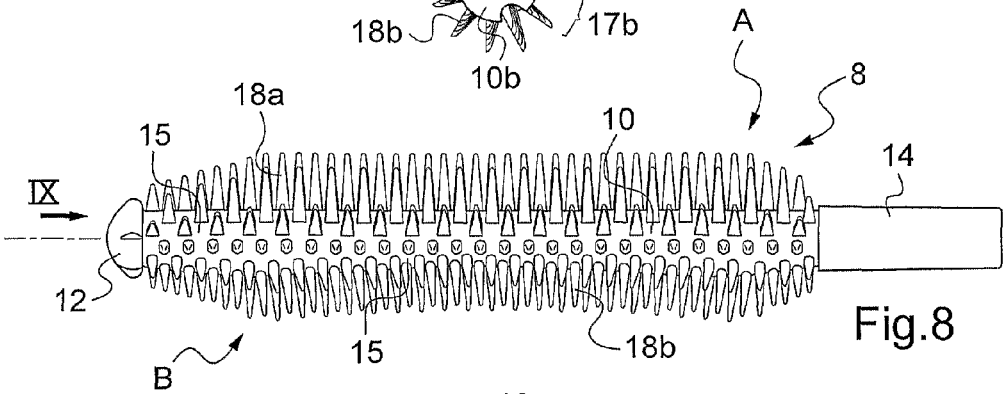
Figure 9:
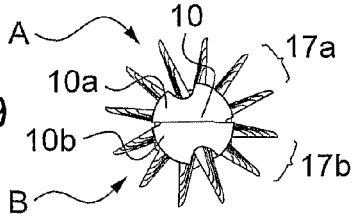

The first portion 10*a* of the embodiment in FIGS. 8 and 9 can correspond to the first portion 10*a* of the embodiment in FIGS. 1 to 3, while the second portion 10*b* of the embodiment in FIGS. 8 and 9 can correspond to the second portion 10*b* of the embodiment in FIGS. 4 and 5.

It should be understood that any combination of portions and of associated teeth are possible for making a wide range of different applicators, with a small number of half-molds assembled together in groups of two to form the mold cavity.

In the above-described embodiments, the core comprises six longitudinal faces and has a cross-section that is of hexagonal shape.

In general manner, the core can comprise any number of longitudinal faces, with it being possible for any of the above-described characteristics to apply regardless of the number of longitudinal faces.

The core can present a cross-section that is circular, as shown in FIG. 10, or oval, as shown in FIG. 11, or even triangular, octagonal, square, or pentagonal, as shown in FIGS. 12, 13, 14, and 15 respectively.

The core 10 can also comprise two halves having shapes that are different, as shown in FIG. 16, the cross-sections of the first portion 10*a* and second portion 10*b* being different. In the embodiment shown in FIG. 16, they are both semi-circular but of radii that are different. In the embodiment shown in FIG. 17, one is semi-circular and the other is triangular. In the embodiment shown in FIG. 18, both are triangular, and in the embodiment shown in FIG. 19, one is triangular and the other is rectangular.

An applicator member 8 of the invention can comprise more than two visible teeth per longitudinal face, when the core is observed along its longitudinal axis, and, in addition to the first and second teeth 18 of the sets 20 and 30, can comprise one or more additional teeth 18, e.g. forming an angle 13 that is greater than $\alpha$ with the direction $Z_1$, or even extending perpendicularly to the face of the corresponding core.

It would not be beyond the ambit of the present invention for the teeth of the second set 30 of teeth not to slope relative to the longitudinal face 15 of the core to which they are connected, and for the directions $Z_1$ and $Z_2$ to be parallel for each row 17.

In the embodiments described above, the teeth of the first and second sets 20 and 30 of teeth 18 are disposed in a staggered configuration, with their bases not being in alignment.

As shown in FIG. 20, this could be otherwise and the bases of the teeth 18 could be in alignment, on a common line L that is parallel to the longitudinal axis X of the core 10 intersecting all of the bases of the aligned teeth of the row, the line constituting the longitudinal axis L of the row.

In addition, FIG. 20 shows rows in which the teeth are spaced apart differently and present different thicknesses.

In the embodiment in FIG. 21, one row comprises teeth that are in alignment, and the other row comprises teeth that are disposed in a staggered configuration.

When the applicator is observed perpendicularly to its longitudinal axis, two consecutive teeth of a row can define a V-shaped groove, as shown in perspective in FIG. 22.

When the applicator member is observed along its longitudinal axis, two consecutive teeth of a row can also form a V-shape, as shown in FIG. 22*a*.

It can be seen in FIGS. 23 and 23*a* that, within a row, the applicator can comprise patterns of four teeth, of which the two middle teeth form a V-shape. The four teeth succeed one another along the longitudinal axis of the row.

In the embodiment shown in FIGS. 23*b* and 23*c*, the row 17 comprises patterns of three teeth, of which two teeth form a V-shape with a tooth disposed between them.

In addition, two rows of teeth of an applicator member 8 of the invention can comprise teeth that are spaced apart from one another by the same spacing, as shown in FIG. 24, or, on the contrary, by different spacings, as shown in FIG. 25.

Within each row, the teeth could be grouped together, e.g. in groups of two. Naturally, the teeth could be grouped together other than in pairs, the spacing between the groups of teeth within the same row optionally being uniform, and in particular greater than the average spacing between the teeth within a group.

In addition, when observed perpendicularly to the longitudinal axis of the core, an applicator member can comprise rows of teeth having profiles defined by their free ends that are identical, as shown in FIGS. 1 to 3, or that are different, as shown in FIG. 26.

In the FIG. 33 embodiment, the two rows of teeth 17 have different profiles, one being in the shape of a camel's back, presenting a central concavity, and the other presenting a central flat.

Furthermore, a plurality of rows of sufficiently close-together teeth form a group of close-together rows, extending along a longitudinal axis G that is parallel to the longitudinal axes L of each of the rows, and that is central relative to said rows. By way of example, FIG. 26*a* shows two groups of two close-together rows, and FIG. 26*b* shows one group of three close-together rows.

The closest teeth of two adjacent rows of the same group are spaced-apart by a distance d that is less than 0.8 mm. The teeth of two different groups can be spaced-apart by a distance d' that is much greater than d, e.g. more that twice, or even three times d.

In the embodiment under consideration, each tooth 18 comprises a first longitudinal face 40 of plane shape and a second longitudinal face 41 of rounded shape, in particular of convex shape.

In a variant, at least one tooth can have a cross-section that is circular, as shown in FIG. 27, or even triangular, as shown in FIG. 28, or lozenge-shaped, as shown in FIG. 29, or even formed of two different-size adjacent triangles, as shown in FIG. 30, or triangular with a groove, as shown in FIG. 31.

In a variant embodiment, the longitudinal faces 15 of the core 10 are twisted, as shown in FIG. 32, i.e. the corresponding side turns through at least one turn towards the distal end of the core.

The core 10 can be deformed on unmolding by turning the endpiece 14, or, in a variant, it can be deformed in the mold.

The longitudinal axis X of the core 10 can coincide with the longitudinal axis Y of the stem 7, but it would not be beyond the ambit of the present invention for this to be otherwise, and, by way of example, FIG. 33 shows a variant embodiment in which the longitudinal axis X of the core 10 forms an angle $\gamma_1$ with the longitudinal axis Y of the stem. Such a configuration can improve application by making it easier to manipulate the applicator.

The core can extend along a longitudinal axis X that is not rectilinear. FIG. 34 shows a variant embodiment in which the core extends along a longitudinal axis X that is curved. When observed in longitudinal section, as in FIG. 34, the envelope surface E can, on one side of the axis X, present a convex first outline 54 that extends substantially in the same direction as the axis X, and, on the opposite side of the axis X, a second outline 55 that possibly presents a concave curve that extends substantially in the same direction as the axis X.

In the variant shown in FIG. 35, the envelope surface E presents two opposite outlines 54 and 55, of which one 54 is straight.

In another variant shown in FIG. 36, the envelope surface E presents a cross-section that passes via a minimum. The axis X coincides with the axis Y.

In the variant shown in FIG. 37, the longitudinal axis X of the core 10 is rectilinear, and the envelope surface E presents an ovoid shape.

In another variant, shown in FIG. 38, the free ends of the teeth 18 define an envelope surface E that extends generally along a longitudinal axis W that forms an angle $\gamma_2$ with the longitudinal axis X of the core 10, where such an applicator member could be said to be excentric.

The FIG. 39 variant differs from the FIG. 38 variant in the shape of the envelope surface E that presents a cross-section that passes via a minimum.

The longitudinal axis X of the core 10 can be rectilinear and can form an angle with the longitudinal axis Y of the stem 7, as shown in FIG. 40, the envelope surface E having, for example, a cross-section that is not constant, e.g. passing via a minimum.

In the variant embodiment shown in FIG. 41, the core comprises a recess in which there is engaged a support portion 60, e.g. made of metal or plastics material. The core can be configured to be fastened to the support portion 60, or it can be free to turn or to move in translation relative to the support portion 60.

The choice of the face of the applicator member used to apply makeup can result in different makeup effects.

The teeth of at least one row could present different heights, passing through an extremum between the extreme teeth of the row, for example.

At least one of the teeth 18 of the rows 17 could present a surface state that is not smooth, e.g. having ridges as a result of molding or roughness linked to the presence of a filler in the plastics material, for example.

The applicator member could be made with a plastics material that comprises magnetic particles. The magnetic field created by such particles, that could be magnetizable and/or magnetized, could, for example, exert an effect on the eyelashes and/or interact with magnetic fibers or pigments that are present in the composition.

The applicator member could be made with flocking, said flocking extending over the teeth only, for example.

At their free ends, the teeth could present respective portions in relief or a particular shape, e.g. a fork, a hook, or a bead, as shown in FIGS. 42 to 44. By way of example, the hook could extend transversally, parallel, or obliquely relative to the longitudinal axis X of the core. In order to obtain the bead, it is possible to heat the applicator member in such a manner as to melt the end of the teeth, for example. In order to obtain the forks or the hooks, it is possible to abrade the applicator member, for example.

The rows 17 could comprise different numbers of teeth, with one of the rows being shorter than another, for example.

All of the teeth could be connected to the core along a direction that is contained in a plane that is perpendicular to the axis X. This could be otherwise, and teeth could slope towards the distal or proximal end.

The wiper member could be made in some other way, e.g. it could comprise a block of foam that could be slotted. The wiper member could be as described in patent applications or US patents Nos. 2005/0028834, 2005/0175394, 2004/0258453, U.S. Pat. Nos. 6,375,374, 6,328,495, for example, the content of which is incorporated herein by reference.

The wiper lip 9 could advantageously be undulating, having a radially-inner free edge defining an orifice 122 through which the applicator member can pass, as shown in FIG. 45. The wiper lip 9 could comprise undulations 120 that extend around the orifice 122. The wiper member 9 can comprise a number of undulations 120 lying in the range 3 to 12, for example.

The wiper lip 9 could extend generally along a cone that converges towards the bottom of the receptacle, and that has a generator line G forming an angle i with the axis X of the receptacle. In a variant, the wiper lip 9 could extend generally along a mid-plane that is perpendicular to the axis X, or it could even extend generally along a cone that converges towards the outlet of the receptacle.

The wiper member could also be adjustable, where appropriate.

The stem 7 to which the core is fastened could be flexible at least in part, and in particular could be entirely flexible, in particular in the proximity of the applicator member. By way of example, the stem could comprise at least one flexible element 80, as shown in FIG. 46, or at least one elastomer element, for example, or it could present a shape that imparts flexibility, e.g. at least one notch 81 as shown in FIG. 47. By way of example, the flexible or elastomer element could be flocked and/or could also be used for applying the composition.

In order to use the device 1, the user can unscrew the closure cap 5 and remove the applicator member 8 from the receptacle 3.

After the applicator member 8 has passed through the wiper member 6, a certain quantity of composition remains between the rows 17 and between the teeth 18 of the rows, and can be applied to the eyelashes or the eyebrows by the user.

The relatively large number of teeth and their disposition on the applicator member make it possible to apply makeup neatly.

The wiping movement used to apply makeup to the eyelashes or the eyebrows can possibly be accompanied by the applicator member being turned about the axis X. In the presence of teeth oriented obliquely on the applicator member, said teeth can be directed towards the eyelashes when applying makeup.

The user can select which side of the applicator member to use as a function of the makeup effect desired.

Still in a variant, vibration could be applied to the applicator member during application, combing, or while taking the composition, e.g. as described in application WO 2006/090343.

Within a row 17, the consecutive teeth 18 may present respective first faces 101 that are substantially plane. The opposite faces 102 of the teeth may be in the form of half a cone or half a pyramid, for example. The teeth 18 may be oriented in alternation with their faces 101 facing towards the midplane of the row and outwards from the row, as shown in FIG. 49. Such a disposition of the teeth can make it easier to mold the row of teeth, since all of the teeth having their faces 101 facing in a given direction are molded by the same mold shell, while all of the other teeth of the row, having their faces 101 facing in the opposite direction are molded by another mold shell. These two mold shells come into contact with each other.

The teeth 18 may touch to a greater or lesser extent within the row, as shown in FIGS. 49 and 50. In particular, the teeth 18 may be substantially touching as shown in FIG. 49, i.e. in contact or with small spacing between one another, e.g. spacing less than or equal to 0.1 mm at their bases. The disposition of the bases of the teeth shown in FIGS. 49 and 50 can be applied to all of the applicator members described in the present application.

Two consecutive teeth of a row may cross when the row is observed along its longitudinal axis L, as shown in FIG. 51.

In a variant, two consecutive teeth of a row may cross when the row is observed perpendicularly to its longitudinal axis L, as shown in FIG. 52, the two crossing teeth then being directed respectively towards the proximal end and towards the distal end of the applicator member.

In accordance with one of the aspects of the invention, the rows of teeth carried by the first portion of the core may have a number of teeth within the row that differs from the number of teeth within rows of teeth carried by the second portion of the core, as shown in FIG. 53.

The rows may not only have different numbers of teeth per row, but the teeth may also be of different heights and/or thicknesses, as also shown in said figure.

The applicator member may present a variety of shapes for its envelope surface E.

In addition to the shape described above, the applicator member may present an envelope surface E that is generally frustoconical in shape, as shown in FIGS. 54 to 56.

The envelope surface E may be centered on the longitudinal axis X of the applicator member core, as shown in FIG. 54, which axis may also coincide with the longitudinal axis Y of the stem 7, as also shown in this figure.

The core 10 may also be generally frustoconical in shape, as can be seen in FIGS. 54 and 55, or it may be in the form of a cylindrical body of revolution as shown in FIG. 56, or it may have some other shape.

FIG. 55 shows the possibility of the axis of the envelope surface E not coinciding with the axis of the core, e.g. being parallel thereto. In the example of FIG. 4, there can be seen by way of example a larger number of rows of teeth extending longitudinally parallel to the axis X on the side of the face A of the applicator member than on the side of the opposite face B, and/or rows having greater numbers of teeth within each row, and/or teeth having thicknesses that differ from the thicknesses of teeth carried by the opposite portion of the core.

In the example of FIG. 55, by way of example, beside the face A there are teeth that are longer than the teeth beside the face B, e.g. having a number of teeth per longitudinal row that differs for each of the faces A and B.

In the example of FIG. 56, and as can also be seen in FIG. 57, it is possible to have a larger number of rows of teeth beside the face B, e.g. with teeth beside the face B being finer than the teeth beside the face A, there being a larger number of teeth within each row, for example.

In the embodiment of FIG. 58, the envelope surface E is of rectangular cross-section, and it presents four longitudinal edges. The rectangle formed by the distal end face is offset by 90° relative to the rectangle formed by the proximal end face, such that the rectilinear edges interconnect the two long sides of the rectangle formed by the distal end face to the two short sides of the rectangle formed by the proximal end face, and vice versa.

The distal end of the envelope surface may optionally be aligned with the longitudinal axis of the stem. In FIG. 59, there can be seen the possibility for the distal end of the envelope surface E to be in alignment with the longitudinal axis Y of the stem 7.

The envelope surface E may be generally peanut-shaped, as shown in FIG. 60. The envelope surface may in particular present two portions of larger cross-section in the vicinities of its proximal and distal ends, with an intermediate portion of smaller cross-section.

For example, it is possible to have portions of larger cross-section with a maximum transverse dimension greater than or equal to 6 mm in zones $z_p$ and $z_d$, these zones respectively lying between the proximal end of the envelope surface and the first quarter of its length and the distal end of the envelope surface and the first quarter of its length going towards the proximal end.

When the envelope surface is a surface of revolution, the zones $z_p$ and $z_d$ may for example be of diameter greater than or equal to a value $d_0$ that is equal to 6 mm, for example.

By way of example, the cumulative length of the portions $z_x$, $z_y$, and $z_z$ inscribed in a cylinder having a diameter of 6 mm occupies more than 70% of the total length $q_{max}$ of the applicator member. The maximum diameter in the zones $z_p$, $z_d$ is equal to 6.4 mm, for example, and the minimum diameter in the central portion is equal to 5.4 mm, for example.

The applicator member may have an envelope surface of varying cross-section, with two portions close to the proximal and distal ends that are not surfaces of revolution about the longitudinal axis of the core. In FIG. 61, there can be seen an applicator member that, when observed from the side along arrow LX in FIG. 61 presents, by way of example, the shape shown in FIG. 60, and when it is observed from above presents a flat shape as shown in FIG. 61.

Figure 62:
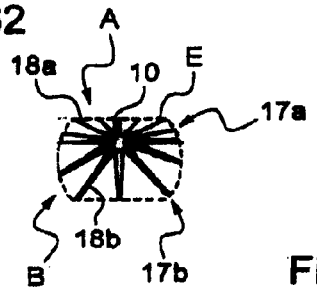
Figure 63:
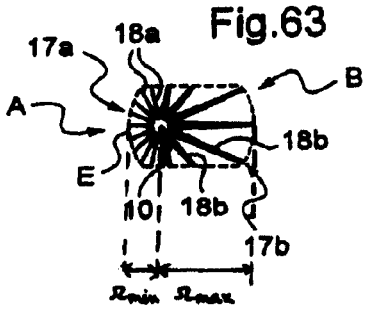

The core 10 may be centered relative to the envelope surface E or it may be off-center relative thereto, as shown in FIGS. 62 and 63. In these examples, it can be seen that the envelope surface E presents a shape in cross-section in a section plane perpendicular to the longitudinal axis X that is generally flat with two opposite faces that are plane and parallel and interconnected by two faces that are outwardly convex.

By way of example, the core 10 is closer to one of the plane faces of the envelope surface than to the other plane face, as shown in FIG. 62, or in a variant it is closer to one of the convex faces of the envelope surface than to the other, as shown in FIG. 63.

The applicator member may present side surfaces 110 that do not have any teeth between the faces A and B, as shown in FIG. 64. By way of example, each side surface 110 extends, as can be seen in the figure, between one of the end rows 17*b* of the set of rows 17*b* and the end row 17*a* of the set of rows 17*a* that is adjacent thereto. By way of example, the angular extent γ of a side surface 110 lies for example in the range 0 to 60°, not including the limit of 0.

In FIG. 74, there can be seen the possibility of having one or more rows of teeth on one of the sides A or B of the applicator member that are missing compared with a regular arrangement of rows of teeth on that side of the applicator member.

FIG. 74 shows that a row of teeth is missing close to one of the extreme rows of the set of rows 17*a*. In other rows, the rows 17*a* are spaced apart from one another at an angular pitch that is constant, except that two of them are spaced apart at twice that angular pitch, for example.

In numerous embodiments, on each of the sides A and B of the applicator member, the rows of teeth extend in at least three different directions about the longitudinal axis of the core. This is not necessarily so, and by way of example, FIG. 75 shows an applicator member for which the teeth on the side A are all parallel, whereas on the opposite side B, the rows of teeth extend in different directions. This figure also shows that the length of the teeth respectively associated with the sides A and B are different. The same can apply to the numbers of teeth within each row 17*a* or 17*b*, and to the thicknesses of the teeth, or indeed to the materials from which the teeth are made.

FIGS. 65 to 73 relate to applicators for applying a composition to keratinous fibers, in particular the eyelashes and/or the eyebrows, the applicators comprised a molded applicator member, comprising:

a stem;

a core that extends along a longitudinal axis;

teeth carried by the core, the distal end of the applicator being defined by the core or by at least one tooth; and teeth extending in at least three different directions around the core and defining an envelope surface that grows to a maximum and then decreases in cross-section towards the free end of the applicator.

In accordance with the invention, such applicators may present different application faces A and B, e.g. differing in number of teeth, e.g. in number of teeth per row, in tooth thickness, in tooth material, and/or in tooth length.

The total length $q_{max}$ along the longitudinal axis of the envelope surface may be less or equal to twice the greatest diameter $d_{max}$ of the cross-section of the envelope surface, better 1.75 times the maximum diameter, better still 1.5 times or 1.25 times.

The angle θ formed by the slope of the envelope surface in at least one longitudinal section on either side of the maximum may be greater than or equal to 120°, better 130°, better still 135°.

The term "diameter $d_{max}$" should be understood as meaning the transverse dimension of the envelope surface, even if the cross-section does not present an outline that is circular.

The term "total length $q_{max}$" should be understood as the total length of the envelope surface as defined by the teeth, and as measured along the longitudinal axis of the core. The angle θ is the angle formed by the slopes of the envelope surface on either side of the maximum, as shown in FIG. 69. These slopes may be straight lines providing the best fit to the envelope surface on either side of the maximum. They may be tangential to a portion of the envelope surface adjacent to the maximum, this portion extending for example over a length as is measured along the longitudinal axis of the core that is equal to 1 mm. The slopes may also be straight lines passing through the maximum and intersecting the envelope surface at a distance from the maximum as measured along the longitudinal axis of the core that is equal to 1 mm.

Such a relatively short applicator can be used to act on the eyelashes or the eyebrows with the stem in a multitude of orientations relative to the row of eyelashes, because of the shape of the envelope surface which defines a ball or a ball-like shape.

By way of example, the multitude of orientations may comprise orientations that are spaced apart by 180° or even more, e.g. by more than 300° in one or more planes. The user can then easily select an orientation and/or a hand movement that is most appropriate for obtaining the desired makeup effect.

Where appropriate, the user may apply makeup by turning the applicator about its axis while moving it in contact with the eyelashes as though it were running along them.

The applicator can be used on its own, e.g. in order to finish off making up the eyelashes or eyebrows onto which a composition has already been applied, or after loading the application element with a composition, loading being performed either by placing the composition on the teeth or by bringing the teeth into contact with a cake of composition or by dipping the applicator into a receptacle containing the composition.

When the applicator is used in association with a receptacle having a wiper member, the shape of the applicator can lead to unequal wiping that can be used to advantage when applying makeup. For example, the zone of greatest diameter of the applicator will be more thoroughly wiped and will be better at separating and extending the eyelashes. The end zone of the applicator can be more heavily loaded with the composition and can be used, for example, to make patches, because it is possible to use the applicator in a multitude of orientations.

The applicator can make it possible to use up excess composition that is often to be found at the end of the brush as a result of the non-zero section of the wiper orifice, and that constitutes an impediment with conventional brushes.

All of the above-mentioned differences between the way teeth are implanted on the two sides A and B of the applicator member can be applied to the examples where the envelope surface is generally of a ball or ball-like shape. For example, the number of rows and/or the number of teeth per row can be greater on one side than on the other.

The applicator may comprise at least one tooth that is not perpendicular to the core. The portion of the core carrying the teeth may be of elongate shape along the longitudinal axis of the applicator.

The core may extend along a longitudinal axis that is rectilinear or curved. When the longitudinal axis of the core is curved, its orientation may vary by less than 90°.

In embodiments, the ratio $R_1=d_{max}/d_{core}$ is greater than or equal to 2.5, better greater than or equal to 3. $d_{core}$ corresponds to the diameter of the circle in which the cross-section of the core is inscribed.

By way of example, $d_{core}$ is greater than or equal to 2 mm and less than or equal to 3 mm, e.g. $d_{core}$ less than or equal to 2.5 mm. For example $d_{max}$ may lie in the range 6 mm to 12 mm, e.g. lying in the range 8 mm to 9 mm.

The generally spherical shape of the applicator can be associated with teeth of varying length, rather than with variation in the diameter of the core supporting them, said variation being observed along the longitudinal axis of the applicator.

$d_{stem}$ designates the diameter of the stem 7, and in the examples of the invention the ratio $R_2=d_{max}/d_{stem}$ is greater than or equal to 2.5, and better greater than or equal to 3.

The core 10 may be made in such a manner that its outer surface is situated in line with the outer surface of the stem 7, once the core is in place on the stem. This makes it possible to avoid having extra thickness present between the core and the stem.

By way of example, the diameter $d_{stem}$ lies in the range 2.5 mm to 3 mm. The core may be held in a housing in the stem as a force-fit, by adhesive, and/or by die stamping the stem onto an endpiece that is made integrally with the core.

The longitudinal axis of the core need not be fully contained in line with the longitudinal axis of the stem.

Advantage should be taken of the fact that the teeth extend over a relatively short length along the longitudinal axis of the applicator to lengthen the stem and thus make the applicator easier to handle.

The relative lengthening in stem length can also serve to improve the extent to which the teeth are impregnated, since they can be moved over a greater distance inside the receptacle prior to being withdrawn therefrom. It is possible to obtain a greater proportion of teeth that are well loaded with the composition, in particular for receptacles that were not initially 100% full, as is common practice to avoid a problem of pistoning while the applicator is being withdrawn.

This can make it possible to use receptacles of relatively shallow depth, e.g. sample receptacles, without that shallow depth of the receptacle causing the applicator to be insufficiently loaded with composition. For example, it is possible to have $R_3=d_{max}/p_{receptacle}$ greater than or equal to 3.

The depth $p_{receptacle}$ of the receptacle is defined as being the distance between the top of the receptacle with no applicator, i.e. the top end of the neck when it has such a neck, and the inside surface at the bottom of the receptacle, with the distance being measured along the longitudinal axis of the receptacle.

Preferably, $R_4=d_{max}/d_f$ (where $d_f$ is the distance between the inside face of the bottom and the bottom end of the wiper member) that is likewise greater than or equal to 3.

The receptacle used may be of any kind, and in particular it may have two portions that are movable relative to each other, with one of the portions being turned relative to the other in order to increase the volume of one chamber defined inside the receptacle between the two portions and decrease the volume of another chamber, thereby causing the composition to pass between those two chambers. This passage takes place through a central portion of the receptacle in which the applicator member is housed. Such a receptacle is described for example in application EP 1 584 260.

The envelope surface may define a cross-section of outline that is circular, at least in part, e.g. having an outline that is circular over at least 180° around the core, or even completely circular, at at least one point along the length of the core, and in particular in the vicinity of the maximum 130, or over at least a fraction of the length of the core, e.g. over the entire length of the fraction of the core that carries the bristles.

The cross-section may have an aspect ratio greater than 0.7, at least in the plane where the radius $r_{max}$ is at its maximum. The envelope surface need not have any notches or outwardly concave faces, e.g. in the plane where the radius $r_{max}$ is at its maximum.

The envelope surface may define at least one radius of length that varies in non-linear manner between the proximal end of the envelope surface and the maximum, e.g. varying along a circular arc or along any other curve other than a straight line. The term "radius" is used to designate the straight line segment going from the core perpendicularly to its axis and terminating in the envelope surface.

The envelope surface may define a radius that varies in non-radial manner between the maximum and the distal end of the envelope surface, e.g. varying along a circular arc.

Beside the maximum, e.g. towards the proximal or distal end of applicator, the envelope surface need not be conical.

The slope on one side of the maximum may vary, e.g. with increasing inclination relative to the longitudinal axis on going towards the distal or proximal end.

The envelope surface may increase and then decrease over at least 180° around the core, better 270° around the core, e.g. 360° around the core.

When seen from the side, i.e. perpendicularly to the axis of the core, the envelope surface may present a profile that is rounded on either side of the maximum.

In the example of FIG. 65, the envelope surface E is a surface of revolution presenting a cross-section that varies, e.g. having two portions 123 and 126 going towards the distal end of the core 10, which portions are substantially hemispherical and joined via an edge 130 defining a maximum where the radius r, i.e. the distance between the envelope surface E and the axis X of the core 10 is the greatest for the entire envelope surface E.

The cross-section of the brush may increase and then decrease on going from the proximal end towards the distal end of the envelope surface along at least two mutually perpendicular axes X1 and X2, as shown in FIG. 65.

In the longitudinal section plane containing the axis X1 that is perpendicular to the axis X, the radius r increases, reaches the maximum $r_{max}$, and then decreases. The same applies in the longitudinal section plane containing the axis X2. The longitudinal section planes containing the respective axes X1 and X2 may be planes of symmetry for the envelope surface.

The distance j between the transverse plane containing the edge 130 and the maximum and the distal end of the envelope surface may be about 5 mm, for example.

The angle θ formed between the slopes 140 and 141 of the envelope surface, and situated respectively on either side of the edge at the maximum 130 can be considerably greater than 120°, as can be seen in FIG. 69.

As shown in FIG. 69, each slope 140 or 141 is defined by the straight line passing through the maximum of the envelope surface E and fitting as closely as possible to the outline of the envelope surface in a longitudinal section plane over a distance of 1 mm along the axis X, on the corresponding side of the maximum.

In the example of a biconical envelope surface, the slopes are respectively the slopes of the two conical portions. In the example of an envelope surface that is spherical, being symmetrical about the plane containing the maximum 130, the angle θ is closer to 180°.

In the example of FIG. 65, the aspect ratio of the brush in the transverse plane containing the edge at the maximum 130 is equal to 1, the envelope surface E presenting a circular outline centered on the axis X of the core 10.

The aspect ratio is defined by $r_{min}/r_{max}$, where $r_{max}$ designates the maximum ratio in the cross-section under consideration, i.e. the greatest distance from the axis X of the core 10 to the envelope surface E, and where $r_{min}$ designates the minimum radius, i.e. the shortest distance from the axis X of the core 10 to the envelope surface E in the section plane.

Figure 70:
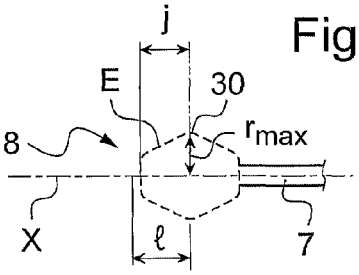

In the example of FIG. 70, the envelope surface is substantially biconical in shape.

The angle θ between the slopes at the maximum is nevertheless relatively large, in particular greater than 120°, so as to approximate to the shape of a ball.

The radius r need not decrease down to zero at the ends of the envelope surface.

Whether in this example or in others, the diameter of the envelope surface E at the distal end may be greater than or equal to 4 mm, for example.

Where appropriate, the envelope surface E may be symmetrical on either side of a midplane containing the maximum 130.

Figure 71:
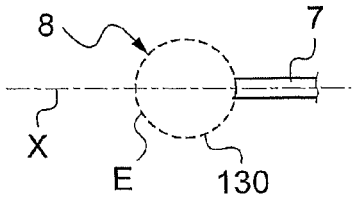

In the example of FIG. 71, the envelope surface E presents a shape in longitudinal section that is generally lenticular. The cross-section defined by the envelope surface E increases for example from a proximal end where the radius r is substantially zero up to the maximum 130, and then decreases to an end where the radius r can again be substantially zero.

The maximum 130 may be defined by an edge, as shown in the above examples. In a variant, the maximum 130 may extend over a certain distance along the axis X, as shown in FIG. 72.

In the example of this figure, the envelope surface E defines a maximum cross-section of radius $r_{max}$ over a distance t prior to decreasing going towards the free end of the core. The middle of this portion of radius $r_{max}$ is situated, by way of example, at a distance l from the free end which is such that the ratio $l/r_{max}$ is less than 1.5. The length t may be greater than or equal to 1 mm, for example.

The envelope surface E, in particular in the plane where the cross-section is at its maximum, may present a shape that is not a surface of revolution.

For example, in a longitudinal section plane over its portion where the cross-section varies, the envelope surface may present an outline that is substantially semicircular on one side of the core and substantially triangular on the other side of the core, as shown in FIG. 73.

By way of example, the maximum radius $r_{max}$ may be defined by the substantially semicircular portion or by the substantially triangular portion.

In certain embodiments, the envelope surface may be at least partially spherical or hemispherical, at least over its portion extending from a plane where the transverse dimension defined by the envelope surface E is at a maximum, all the way to the distal end.

As shown in FIGS. 67 to 68, the applicator may have teeth that point towards the proximal end of the applicator.

The applicator may comprise teeth that extend in more than four directions around the axis of the core, better that extend in at least eight directions around the axis X of the core, and in particular in more than eight directions.

As shown in FIGS. 66 to 68, the core 10 and the envelope surface E may both pass through a respective maximum cross-section at the same axial position along the axis X.

The teeth may present a height that varies such that their free ends define the profile desired for the envelope surface E. By way of example the core 10 may be elongate in shape, e.g. cylindrical, and the envelope surface may be generally ball-shaped.

By way of example, the radius r of the envelope surface E may vary by less than 50% between one-fourth and one-half of the distance between the plane containing the maximum 130 and the distal end of the applicator.

When the applicator is loaded with composition by being inserted into a receptacle through a wiper member, the teeth of the applicator may bend towards the distal end while the applicator is being withdrawn in certain embodiments. Some of the teeth may be long enough and close enough to the distal end for them, on bending, to cover the shorter teeth situated closer to the distal end. While bending on passing through the wiper member, the free ends of some of the teeth may come substantially level with the distal end of the core along the axis X.

In other aspects of the invention, the applicator may have an envelope surface with any of the following characteristics.

The envelope surface (E) defined by the teeth may increase and then decrease going towards the distal end of the applicator.

The envelope surface may present a distal portion that is at least partially spherical or hemispherical.

The total length $q_{max}$ along the longitudinal axis of the envelope surface (E) may be less than or equal to twice the greatest diameter $d_{max}$ of the cross-section of the envelope surface.

The total length $q_{max}$ may verify $q_{max} \leq 1.75\ d_{max}$, preferably with $q_{max} \leq 1.5\ d_{max}$, better with $q_{max} \leq 1.25\ d_{max}$.

The angle θ formed by the slopes of the envelope surface at least in a longitudinal section on either side of a maximum of the envelope surface may be greater than 120°.

The envelope surface may have an aspect ratio ($r_{min}/r_{max}$) greater than 0.7, at least in the transverse plane comprising the maximum 130.

The greatest radius $r_{max}$ measured at the maximum 130 may be greater than or equal to 3 mm.

The distance (l) from the transverse plane containing the maximum 130 to the distal end of the applicator may be less than or equal to 12 mm.

The maximum 130 be situated at a distance ($r_{max}$) lying in the range 2.5 mm to 2.75 mm from the axis (X) of the core 10.

The ratio $R_1 = d_{max}/d_{core}$ may be greater than or equal to 2.5, where $d_{core}$ corresponds to the diameter of the circle in which the cross-section of the core is inscribed.

The ratio $R_2 = d_{max}/d_{stem}$ may be greater than or equal to 2.5, where $d_{stem}$ corresponds to the maximum diameter of the stem.

In a variant not shown, the envelope surface is hemispherical opposite the first or second portion, and the remained of the envelope surface may have any other shape for example ellipsoidal.

Such an applicator may also present at least one of the characteristics of the applicators described with reference to the figures of the present application.

Naturally, the invention is not limited to the above-described embodiments, the characteristics of which can be combined together within variants not shown.

The term "comprising a" should be understood as being synonymous with the term "comprising at least one" unless specified to the contrary.

The expression "lying in the range" should be construed as including the limits of the range.

The invention claimed is:

1. An applicator for combing eyelashes and/or eyebrows, and/or for applying a cosmetic, makeup, or a care product thereto, the applicator comprising an applicator member molded in one piece that comprises:

an inner core that is elongate along a longitudinal axis, and comprising opposite first and second portions that each extend along the longitudinal axis, each of the first and second portions extending angularly, continuously around the longitudinal axis over an angular sector in the range of 150° to 210°, the first and second portions being entirely situated on respective opposite sides of at least a plane comprising the longitudinal axis of the inner core; and a plurality of rows of teeth, the rows extending along the longitudinal axis of the core, with first rows and second rows of teeth extending from the first and second portions of the core respectively, a number of the first rows of teeth being equal to a number of the second rows of teeth, the teeth of each row of each of the plurality of rows of teeth being disposed in a staggered configuration with their bases not being in alignment, the first rows of teeth defining a first application surface of the applicator member and the second rows of teeth defining a second application surface of the applicator member, wherein in a cross section taken transverse to the longitudinal axis of the core of the applicator member, crossing from the first application surface to the second application surface occurs a single time in a clockwise direction;

at least half of the teeth of at least two consecutive first rows differing from at least half of the teeth of at least two consecutive second rows in their thickness, wherein the applicator member has no axis of symmetry in at least one cross-section taken transverse to the longitudinal axis of the core, each of the first and second portions comprising teeth that extend in at least three different directions.

2. An applicator according to claim 1, wherein at least half of the first rows of teeth have a number of teeth per row that differs from a number of teeth per row of at least half of the second rows.

3. An applicator according to claim 1, wherein all of the first rows carried by the first portion have a same number of teeth each, and all of the second rows carried by the second portion likewise have a same number of teeth each, the number $n_1$ of teeth in the first rows differing from the number $n_2$ of teeth in the second rows.

4. An applicator according to claim 3, wherein $n_1/n_2 \geq 1.3$.

5. An applicator according to claim 3, wherein $n_1/n_2 \geq 1.8$.

6. An applicator according to claim 1, wherein the teeth of the first rows differ from the teeth of the second rows in at least two characteristics among their thickness, shape, length, material, hardness, spacing in the row, number of teeth in the row, and/or orientation in the row.

7. An applicator according to claim 1, wherein, over at least a fraction of its length, the core has a cross-section of shape selected from the following list: circular; semi-circular; elliptical; semi-elliptical; polygonal; triangular; square; rectangular; pentagonal; hexagonal; octagonal; and semi-polygonal.

8. An applicator according to claim 1, wherein the first and second rows of teeth comprise rows of teeth having a length, measured from the core, that is less than 1.8 mm.

9. An applicator according to claim 1, wherein the first and second rows of teeth comprise rows of teeth having a length, measured from the core, in the range 1.35 mm to 3 mm.

10. An applicator according to claim 9, wherein the first rows of teeth have more teeth per row than the second rows.

11. An applicator according to claim 1, wherein at least two successive teeth of a row of teeth, the row being selected among the first and second rows of teeth, are touching at their bases.

12. An applicator according to claim 1, wherein each of two consecutive teeth of a row of teeth, the row being selected among the first and second rows of teeth, extends along a direction from the core, the two directions forming an angle between them.

13. An applicator according to claim 1, wherein at least one tooth has at least one plane face that is parallel to a length direction of the at least one tooth.

14. An applicator according to claim 1, wherein each row of the first and second rows of teeth comprise between 3 and 20 rows of teeth.

15. An applicator according to claim 1, wherein the applicator member has a greatest transverse dimension measured perpendicularly to the longitudinal axis of the core that is less than or equal to 6 mm.

16. An applicator according to claim 1, wherein an area of a cross section of an envelope surface defined by free ends of the teeth of the first and second rows of teeth and being a combination of the first and second application surfaces increases and then decreases going towards a distal end of the applicator.

17. An applicator according to claim 16, wherein the envelope surface presents a distal portion that is at least partially spherical.

18. An applicator according to claim 1, wherein the first and second portions of the core comprise the same material.

19. An applicator according to claim 1, wherein the teeth of the first rows of teeth and the teeth of the second rows of teeth comprise the same material.

20. An applicator according to claim 1, wherein the teeth of the first rows of teeth and the first portion of the core comprise the same material.

21. An applicator according to claim 1, wherein the teeth of the second rows of teeth and the second portion of the core comprise the same material.

22. An applicator according to claim 1, wherein the teeth of the first rows of teeth comprise a material that is different from the first portion of the core.

23. An applicator according to claim 1, wherein the first and second portions of the core comprise different materials.

24. An applicator according to claim 1, wherein the teeth of the first rows of teeth and the teeth of the second rows of teeth comprise different materials.

25. An applicator according to claim 1, wherein at least one of the first portion and of the second portion of the core has a cross-section that is substantially constant along the longitudinal axis.

26. An applicator according to claim 1, wherein at least one of the first portion and of the second portion of the core has a cross-section that varies along the longitudinal axis.

27. An applicator according to claim 1, wherein a ratio of a greatest transverse dimension of the first portion of the core over a greatest transverse dimension of the second portion is in the range 0.5 to 2.

28. An applicator according to claim 1, wherein the first rows of teeth, each have the same shape that are mirror images of each other on turning about the longitudinal axis of the core.

29. An applicator according to claim 1, wherein the second rows of teeth, each have the same shape that are mirror images of each other on turning about the longitudinal axis of the core.

30. An applicator according to claim 1, wherein the ends of the teeth of the first rows of teeth define a first half envelope surface of the applicator, the ends of the teeth of the second rows of teeth define a second half envelope surface of the applicator, the first and second half envelope surfaces having shapes that are different.

31. An applicator according to claim 1, wherein at least two successive teeth of a row of the first and second rows of teeth are non-touching at their bases.

32. An applicator according to claim 1, wherein, when the applicator is observed perpendicularly to its the longitudinal axis of the core, at least two consecutive teeth define a V-shaped groove therebetween.

33. An applicator according to claim 1, wherein at least one tooth of the teeth of a combination of the first and second rows of teeth presents a cross-section that is circular, semi-circular, semi-elliptical, elliptical, polygonal, triangular, square, rectangular, octagonal, parallelogram-shaped, lozenge-shaped, or oval.

34. An applicator according to claim 1, wherein at least one tooth of a combination of first and second rows of teeth presents at least one portion in relief.

35. An applicator according to claim 1, wherein the longitudinal axis of the core is rectilinear.

36. An applicator according to claim 1, wherein the longitudinal axis of the core is curved.

37. An applicator according to claim 1, wherein the core comprises a recess in which there is engaged a support portion.

38. An applicator according to claim 1, wherein the core presents a cross-section, taken transverse to the longitudinal axis of the core, that has an area that increases and then decreases along the longitudinal axis of the core.

39. An applicator according to claim 1, wherein the first or second portion of the core or each of the first and second portions of the core comprises at least one longitudinal face from which teeth extend, the longitudinal face presenting a width that varies along the longitudinal axis of the core.

40. An applicator according to claim 1, comprising a stem, the applicator member extending from a first end of the stem.

41. An applicator according to claim 40, wherein the stem is connected to a handle at a second end remote from the first end.

42. An applicator according to claim 40, the longitudinal axis of the core being rectilinear and forming an angle with a longitudinal axis of the stem.

43. An applicator according to claim 1, wherein a total length $q_{max}$ of an envelope surface defined by free ends of the teeth of the first and second rows of teeth along the longitudinal axis and being a combination of the first and second application surfaces is less than or equal to twice a greatest diameter $d_{max}$ of a cross-section of the envelope surface.

44. An applicator according to claim 43, wherein an angle θ formed by slopes of the envelope surface at least in a longitudinal section on either side of a greatest diameter $d_{max}$ of the envelope surface is greater than 120°.

45. An applicator according to claim 43, wherein $q_{max} \leq 1.75\ d_{max}$.

46. An applicator according to claim 43, wherein the envelope surface has an aspect ratio ($r_{min}/r_{max}$) greater than 0.7, at least in a cross-section of an envelope surface taken transverse to the longitudinal axis of the core and comprising a greatest diameter $d_{max}$ of the envelope surface, $r_{min}$ and $r_{max}$ being a minimum and maximum radius of the cross-section.

47. An applicator according to claim 43, wherein a greatest radius $r_{max}$ of a cross-section of the envelope surface taken transverse to the longitudinal axis of the core comprising a greatest diameter $d_{max}$ of the envelope surface is greater than or equal to 3 mm.

48. An applicator according to claim 43, wherein a distance from a transverse plane containing a greatest diameter $d_{max}$ of the envelope surface to a distal end of the applicator is less than or equal to 12 mm.

49. An applicator according to claim 43, wherein a greatest diameter $d_{max}$ of the envelope surface is situated at a distance ($r_{max}$) in the range 2.5 mm to 2.75 mm from the axis of the core.

50. An applicator according to claim 43, wherein a ratio $R_1=d_{max}/d_{core}$ is greater than or equal to 2.5, where $d_{core}$ corresponds to a diameter of a circle in which a cross-section taken transverse to the longitudinal axis of the core of the applicator member is inscribed.

51. An applicator according to claim 43, wherein a ratio $R_2=d_{max}/d_{stem}$, is greater than or equal to 2.5, where $d_{stem}$ corresponds to a maximum diameter of the stem.

52. A packaging and applicator device for applying a cosmetic or a care product to eyelashes and/or eyebrows, the device comprising an applicator as defined in claim 1, and a receptacle containing a composition for application to the eyelashes and/or the eyebrows, wherein the applicator further comprises a stem and a handle, the applicator member extending from a first end of the stem, the stem being connected to the handle at a second end remote from the first end, and wherein a handle of the applicator constitutes a closure cap for closing the receptacle.

53. A device according to claim 52, the receptacle comprising a wiper member for wiping the applicator member.

54. A device according to claim 52, wherein the composition is a mascara.

55. An applicator according to claim 1, wherein at least two consecutive teeth of a row of the plurality of rows of teeth each have first faces having a common flat shape and second faces having a common second rounded shape.

56. An applicator according to claim 1, wherein, over at least a fraction of its length, the core has a cross-section taken transverse to the longitudinal axis of the core that is of hexagonal shape.

* * * * *